US011659863B2

(12) United States Patent
Blandino et al.

(10) Patent No.: US 11,659,863 B2
(45) Date of Patent: May 30, 2023

(54) ARTICLE FOR USE WITH APPARATUS FOR HEATING SMOKABLE MATERIAL

(71) Applicant: NICOVENTURES TRADING LIMITED, London (GB)

(72) Inventors: Thomas P. Blandino, Cottage Grove, WI (US); Andrew Wilke, Madison, WI (US)

(73) Assignee: Nicoventures Trading Limited, London (GB)

( * ) Notice: Subject to any disclaimer, the term of this patent is extended or adjusted under 35 U.S.C. 154(b) by 6 days.

(21) Appl. No.: 15/754,823

(22) PCT Filed: Aug. 26, 2016

(86) PCT No.: PCT/EP2016/070188
§ 371 (c)(1),
(2) Date: Feb. 23, 2018

(87) PCT Pub. No.: WO2017/036957
PCT Pub. Date: Mar. 9, 2017

(65) Prior Publication Data

US 2018/0279677 A1 Oct. 4, 2018

Related U.S. Application Data

(63) Continuation of application No. 14/840,854, filed on Aug. 31, 2015, now abandoned.

(51) Int. Cl.
*A24F 40/42* (2020.01)
*H05B 6/36* (2006.01)
(Continued)

(52) U.S. Cl.
CPC ..... *A24F 40/42* (2020.01); *A24F 40/00* (2020.01); *A24F 40/46* (2020.01); *A24F 40/465* (2020.01); *H05B 6/36* (2013.01); *A24F 40/20* (2020.01)

(58) Field of Classification Search
CPC ..... A24F 47/008; A24F 40/00; A24F 40/20; A24F 40/40; A24F 40/42; A24F 40/46
(Continued)

(56) References Cited

U.S. PATENT DOCUMENTS 219,628 A 9/1879 Edison
219,634 A 9/1879 Gifford
(Continued)

FOREIGN PATENT DOCUMENTS

AT 262137 B 5/1968
AT 306224 B 3/1973
(Continued)

OTHER PUBLICATIONS

CN203952405 (Machine Translation) [online], [retrieved on Mar. 7, 2022], retrieved from ESPACENET (https://worldwide.espacenet.com/) (Year: 2014).*
(Continued)

*Primary Examiner* — Galen H Hauth
*Assistant Examiner* — Yana B Krinker
(74) *Attorney, Agent, or Firm* — Patterson Thuente, P.A.

(57) ABSTRACT

Disclosed is an article for use with apparatus for heating smokable material to volatilize at least one component of the smokable material. The article includes a cavity for receiving smokable material, and a coil of heating material that is heatable by penetration with a varying magnetic field to heat the cavity. Also disclosed is a system including the article and apparatus. The apparatus has an interface for cooperating with the article, and a magnetic field generator. The magnetic field generator includes a coil for generating a varying magnetic field for penetrating the coil of the article when the interface is cooperating with the article. An impedance of the coil of the magnetic field generator is equal, or substantially equal, to an impedance of the coil of the article.

21 Claims, 2 Drawing Sheets

(51) Int. Cl.

| | |
|---|---|
| ***A24F 40/465*** | (2020.01) |
| ***A24F 40/46*** | (2020.01) |
| ***A24F 40/00*** | (2020.01) |
| *A24F 40/20* | (2020.01) |

(58) Field of Classification Search
USPC ..... 131/270–273, 194, 329
See application file for complete search history.

(56) References Cited

U.S. PATENT DOCUMENTS 219,635 A 9/1879 Giles
219,643 A 9/1879 Mattoni
844,272 A 2/1907 Fate
912,986 A 2/1909 Aschenbrenner
1,071,817 A 9/1913 Stanley
1,771,366 A 7/1930 Wyss et al.
1,886,391 A 11/1932 Henri et al.
2,057,353 A 10/1936 Whittemore
2,104,266 A 1/1938 McCormick
2,462,563 A 2/1949 Seyforth et al.
2,473,325 A 6/1949 Aufiero
2,689,150 A 9/1954 Croce et al.
2,809,634 A 10/1957 Hirotada et al.
2,888,208 A 5/1959 Rene et al.
3,040,991 A 6/1962 Rene et al.
3,043,524 A 7/1962 Sonia et al.
3,111,396 A 11/1963 Ball
3,144,174 A 8/1964 Henry et al.
3,225,954 A 12/1965 Herrick et al.
3,258,015 A 6/1966 Drummond et al.
3,265,236 A 8/1966 Norman et al.
3,289,949 A 12/1966 Willy et al.
3,347,231 A 10/1967 Chang
3,402,724 A 9/1968 Blount et al.
3,431,393 A 3/1969 Katsuda et al.
3,433,632 A 3/1969 Elbert et al.
3,521,643 A 7/1970 Toth et al.
3,522,806 A 8/1970 Szekely et al.
3,604,428 A 9/1971 Moukaddem
3,647,143 A 3/1972 Gauthier et al.
3,658,059 A 4/1972 Steil et al.
3,733,010 A 5/1973 Riccio et al.
3,804,100 A 4/1974 Fariello
3,805,806 A 4/1974 Grihalva
3,856,185 A 12/1974 Riccio et al.
3,864,326 A 2/1975 Babington et al.
3,889,690 A 6/1975 Guarnieri
3,913,843 A 10/1975 Cambio, Jr. et al.
3,943,942 A 3/1976 Anderson et al.
3,964,902 A 6/1976 Fletcher et al.
4,009,713 A 3/1977 Simmons et al.
4,017,701 A 4/1977 Mittelmann
4,031,906 A 6/1977 Knapp
4,094,119 A 6/1978 Sullivan
4,145,001 A 3/1979 Weyenberg et al.
4,149,548 A 4/1979 Bradshaw et al.
4,161,283 A 7/1979 Hyman
4,171,000 A 10/1979 Uhle
4,193,513 A 3/1980 Bull, Jr.
4,284,089 A 8/1981 Ray et al.
4,299,274 A 11/1981 Campbell et al.
4,299,355 A 11/1981 Haekkinen et al.
4,303,083 A 12/1981 Burruss, Jr.
4,303,541 A 12/1981 Wasel-Nielen et al.
4,393,884 A 7/1983 Jacobs
4,412,930 A 11/1983 Koike et al.
4,427,123 A 1/1984 Komeda et al.
4,429,835 A 2/1984 Brugger et al.
4,474,191 A 10/1984 Steiner
4,503,851 A 3/1985 Braunroth
4,588,976 A 5/1986 Jaselli
4,628,187 A 12/1986 Sekiguchi et al.
4,638,820 A 1/1987 Roberts et al.
4,675,508 A 6/1987 Miyaji et al.
4,676,237 A 6/1987 Wood et al.
4,677,992 A 7/1987 Bliznak
4,694,841 A 9/1987 Esparza
4,734,097 A 3/1988 Tanabe et al.
4,735,217 A 4/1988 Gerth et al.
4,746,067 A 5/1988 Svoboda
4,756,318 A 7/1988 Clearman et al.
4,765,347 A * 8/1988 Sensabaugh, Jr. .... A24F 47/002 131/173
4,765,348 A 8/1988 Honeycutt
4,771,795 A 9/1988 White et al.
4,776,353 A 10/1988 Lilja et al.
4,819,665 A 4/1989 Roberts et al.
4,827,950 A 5/1989 Banerjee et al.
4,830,028 A 5/1989 Lawson et al.
4,848,374 A 7/1989 Chard et al.
4,885,129 A 12/1989 Leonard et al.
4,892,109 A 1/1990 Strubel
4,907,606 A 3/1990 Lilja et al.
4,913,168 A 4/1990 Potter et al.
4,917,119 A 4/1990 Potter et al.
4,917,120 A 4/1990 Hill
4,917,301 A 4/1990 Munteanu
4,922,901 A 5/1990 Brooks et al.
4,924,883 A 5/1990 Perfetti et al.
4,938,236 A 7/1990 Banerjee et al.
4,941,483 A 7/1990 Ridings et al.
4,945,929 A 8/1990 Egilmex
4,945,931 A 8/1990 Gori
4,947,874 A 8/1990 Brooks et al.
4,947,875 A 8/1990 Brooks et al.
4,955,399 A 9/1990 Potter et al.
4,978,814 A 12/1990 Honour
4,979,521 A 12/1990 Davis et al.
4,987,291 A 1/1991 McGaffigan et al.
4,991,606 A 2/1991 Serrano et al.
5,019,122 A 5/1991 Clearman et al.
5,020,509 A 6/1991 Suzuki et al.
5,027,837 A 7/1991 Clearman et al.
5,040,551 A 8/1991 Schlatter et al.
5,040,552 A 8/1991 Schleich et al.
5,042,509 A 8/1991 Banerjee et al.
5,046,514 A 9/1991 Bolt
5,060,667 A 10/1991 Strubel
5,060,671 A 10/1991 Counts et al.
5,076,292 A 12/1991 Sensabaugh, Jr. et al.
5,080,115 A 1/1992 Templeton
5,093,894 A 3/1992 Deevi et al.
5,095,647 A 3/1992 Zobele et al.
5,095,921 A 3/1992 Losee et al.
5,096,921 A 3/1992 Bollinger et al.
5,097,850 A 3/1992 Braunshteyn et al.
5,099,861 A 3/1992 Clearman et al.
5,105,831 A 4/1992 Banerjee et al.
5,119,834 A 6/1992 Shannon et al.
5,121,881 A 6/1992 Lembeck
5,133,368 A 7/1992 Neumann et al.
5,143,048 A 9/1992 Cheney, III
5,144,962 A 9/1992 Counts et al.
5,146,934 A 9/1992 Deevi et al.
5,159,940 A 11/1992 Hayward et al.
5,167,242 A 12/1992 Turner et al.
5,179,966 A 1/1993 Losee et al.
5,188,130 A 2/1993 Hajaligol et al.
5,190,060 A 3/1993 Gerding et al.
5,203,355 A 4/1993 Clearman et al.
5,224,498 A 7/1993 Deevi et al.
5,230,715 A 7/1993 Iizuna et al.
5,235,992 A 8/1993 Sensabaugh, Jr.
5,247,947 A 9/1993 Clearman et al.
5,249,586 A 10/1993 Morgan et al.
5,251,688 A 10/1993 Schatz
5,261,424 A 11/1993 Sprinkel et al.
5,269,327 A 12/1993 Counts et al.
5,271,980 A 12/1993 Bell
5,272,216 A 12/1993 Clark, Jr. et al.
5,285,798 A 2/1994 Banerjee et al.
5,293,883 A 3/1994 Edwards
5,303,720 A 4/1994 Banerjee et al.

(56) References Cited

U.S. PATENT DOCUMENTS 5,305,733 A 4/1994 Walters
5,312,046 A 5/1994 Knoch et al.
5,322,075 A 6/1994 Deevi et al.
5,327,915 A 7/1994 Porenski et al.
5,331,979 A 7/1994 Henley
5,345,951 A 9/1994 Serrano et al.
5,353,813 A 10/1994 Deevi et al.
5,357,984 A 10/1994 Farrier et al.
5,369,723 A 11/1994 Counts et al.
5,372,148 A 12/1994 McCafferty et al.
5,388,574 A 2/1995 Ingebrethsen
5,388,594 A 2/1995 Counts et al.
5,390,864 A 2/1995 Alexander
5,396,911 A 3/1995 Casey, III et al.
5,400,808 A 3/1995 Turner et al.
5,402,803 A 4/1995 Takagi
5,408,574 A 4/1995 Deevi et al.
5,412,183 A 5/1995 Buffenoir et al.
5,415,186 A 5/1995 Casey, III et al.
5,434,388 A 7/1995 Kralik et al.
5,443,560 A 8/1995 Deevi et al.
5,454,363 A 10/1995 Sata
5,461,695 A 10/1995 Knoch
5,468,936 A 11/1995 Deevi et al.
5,474,059 A 12/1995 Cooper
5,479,948 A 1/1996 Counts et al.
5,483,953 A 1/1996 Cooper
5,497,792 A 3/1996 Prasad et al.
5,499,636 A 3/1996 Baggett, Jr. et al.
5,500,511 A 3/1996 Hansen
5,501,236 A 3/1996 Hill et al.
5,502,743 A 3/1996 Conochie et al.
5,505,214 A 4/1996 Collins et al.
5,511,538 A 4/1996 Haber et al.
5,517,981 A 5/1996 Taub et al.
5,530,225 A 6/1996 Hajaligol
5,534,020 A 7/1996 Cheney, III et al.
5,538,020 A 7/1996 Farrier et al.
5,540,241 A 7/1996 Kim
5,549,906 A 8/1996 Santus
5,553,791 A 9/1996 Alexander
5,564,442 A 10/1996 MacDonald et al.
5,573,140 A 11/1996 Satomi et al.
5,573,692 A 11/1996 Das et al.
5,591,368 A 1/1997 Fleischhauer
5,593,792 A 1/1997 Farrier et al.
5,613,504 A 3/1997 Collins et al.
5,613,505 A 3/1997 Campbell
5,636,787 A 6/1997 Gowhari
5,645,749 A 7/1997 Wang
5,649,554 A 7/1997 Sprinkel et al.
5,659,656 A 8/1997 Das
5,665,262 A 9/1997 Hajaligol et al.
5,666,977 A 9/1997 Higgins et al.
5,687,912 A 11/1997 Denyer
5,692,291 A 12/1997 Deevi et al.
5,699,786 A 12/1997 Oshima et al.
5,711,292 A 1/1998 Hammarlund
5,726,421 A 3/1998 Fleischhauer
5,736,110 A 4/1998 Angelillo et al.
5,742,251 A 4/1998 Gerber
5,743,251 A 4/1998 Howell et al.
5,771,845 A 6/1998 Pistien et al.
5,778,899 A 7/1998 Saito et al.
5,798,154 A 8/1998 Bryan
5,837,088 A 11/1998 Palmgren
5,845,649 A 12/1998 Saito et al.
5,865,185 A 2/1999 Collins et al.
5,865,186 A 2/1999 Volsey et al.
5,878,752 A 3/1999 Adams et al.
5,902,501 A 5/1999 Nunnally et al.
5,921,233 A 7/1999 Gold et al.
5,935,486 A 8/1999 Bell et al.
5,938,125 A 8/1999 Ritsche et al.
5,958,273 A 9/1999 Koch et al.
5,984,953 A 11/1999 Sabin et al.
6,000,394 A 12/1999 Blaha-Schnabel et al.
6,026,820 A 2/2000 Baggett et al.
6,037,568 A 3/2000 Hatanaka et al.
6,040,560 A 3/2000 Fleischhauer et al.
6,041,790 A 3/2000 Smith et al.
6,053,176 A 4/2000 Adams et al.
6,058,711 A 5/2000 Maciaszek et al.
6,079,405 A 6/2000 Justo
6,085,741 A 7/2000 Becker
6,089,857 A 7/2000 Matsuura et al.
6,095,505 A 8/2000 Miller
6,113,078 A 9/2000 Rock
6,116,231 A 9/2000 Sabin et al.
6,125,853 A 10/2000 Susa et al.
6,129,080 A 10/2000 Pitcher et al.
6,155,268 A 12/2000 Takeuchi
6,158,676 A 12/2000 Hughes
6,164,287 A 12/2000 White
6,178,963 B1 1/2001 Baik
6,209,457 B1 4/2001 Kenworthy et al.
6,223,745 B1 5/2001 Hammarlund et al.
6,224,179 B1 5/2001 Wenning et al.
6,230,703 B1 5/2001 Bono
6,234,459 B1 5/2001 Rock
6,244,573 B1 6/2001 Rock
6,248,257 B1 6/2001 Bell et al.
6,267,110 B1 7/2001 Tenenboum et al.
6,275,650 B1 8/2001 Lambert
6,283,116 B1 9/2001 Yang
6,289,889 B1 9/2001 Bell et al.
6,297,483 B2 * 10/2001 Sadahira ..... H05B 6/36 219/629
6,315,366 B1 11/2001 Post et al.
6,347,789 B1 2/2002 Rock
6,376,816 B2 4/2002 Cooper et al.
6,427,878 B1 8/2002 Greiner-Perth et al.
6,595,209 B1 7/2003 Rose et al.
6,598,607 B2 7/2003 Adiga et al.
6,644,383 B2 11/2003 Joseph et al.
6,648,306 B2 11/2003 Rock
6,652,804 B1 11/2003 Neumann et al.
6,669,176 B2 12/2003 Rock
6,681,998 B2 1/2004 Sharpe et al.
6,701,921 B2 3/2004 Sprinkel, Jr. et al.
6,708,846 B1 3/2004 Fuchs et al.
6,723,115 B1 4/2004 Daly
6,761,164 B2 7/2004 Amirpour et al.
6,769,436 B2 8/2004 Horian
6,790,496 B1 9/2004 Levander et al.
6,799,572 B2 10/2004 Nichols et al.
6,803,545 B2 10/2004 Blake et al.
6,803,550 B2 10/2004 Sharpe et al.
6,827,080 B2 12/2004 Fish et al.
6,868,230 B2 3/2005 Gerhardinger
6,886,556 B2 5/2005 Fuchs
6,953,474 B2 10/2005 Lu
6,968,888 B2 11/2005 Kolowich
6,994,096 B2 2/2006 Rostami
7,012,227 B2 3/2006 Tathgur et al.
7,041,123 B2 5/2006 Stapf et al.
7,077,130 B2 7/2006 Nichols et al.
7,081,211 B2 7/2006 Li et al.
7,088,914 B2 8/2006 Whittle et al.
7,100,618 B2 9/2006 Dominguez
7,112,712 B1 9/2006 Ancell
7,163,014 B2 1/2007 Nichols et al.
7,185,659 B2 3/2007 Sharpe
7,234,459 B2 6/2007 Del
7,235,187 B2 6/2007 Li et al.
7,263,282 B2 8/2007 Meyer
7,290,549 B2 11/2007 Banerjee et al.
7,303,328 B2 12/2007 Faraldi et al.
7,335,186 B2 2/2008 O'Neil
7,373,938 B2 5/2008 Nichols et al.
7,374,063 B2 5/2008 Reid
7,400,940 B2 7/2008 McRae et al.
7,434,584 B2 10/2008 Steinberg
7,458,374 B2 12/2008 Hale et al.

(56) References Cited

U.S. PATENT DOCUMENTS

| | | | |
|---|---|---|---|
| 7,540,286 | B2 | 6/2009 | Cross et al. |
| 7,581,540 | B2 | 9/2009 | Hale et al. |
| 7,581,718 | B1 | 9/2009 | Chang |
| 7,585,493 | B2 | 9/2009 | Hale et al. |
| 7,624,739 | B2 | 12/2009 | Snaidr et al. |
| 7,645,442 | B2 | 1/2010 | Hale et al. |
| 7,665,461 | B2 | 2/2010 | Zierenberg et al. |
| 7,726,320 | B2 | 6/2010 | Robinson et al. |
| 7,767,698 | B2 | 8/2010 | Warchol et al. |
| 7,832,397 | B2 | 11/2010 | Lipowicz |
| 7,832,410 | B2 | 11/2010 | Hon |
| 7,834,295 | B2 | 11/2010 | Sharma et al. |
| 7,913,688 | B2 | 3/2011 | Cross et al. |
| 7,987,846 | B2 | 8/2011 | Hale et al. |
| 7,992,554 | B2 | 8/2011 | Radomski et al. |
| 8,061,361 | B2 | 11/2011 | Maeder et al. |
| 8,079,371 | B2 | 12/2011 | Robinson et al. |
| 8,081,474 | B1 | 12/2011 | Zohni et al. |
| 8,118,021 | B2 | 2/2012 | Cho et al. |
| 8,156,944 | B2 | 4/2012 | Han |
| 8,342,184 | B2 | 1/2013 | Inagaki et al. |
| 8,365,742 | B2 | 2/2013 | Hon |
| 8,375,957 | B2 | 2/2013 | Hon |
| 8,393,331 | B2 | 3/2013 | Hon |
| 8,402,976 | B2 | 3/2013 | Fernando |
| 8,430,106 | B2 | 4/2013 | Potter et al. |
| 8,439,046 | B2 | 5/2013 | Peters et al. |
| 8,459,271 | B2 | 6/2013 | Inagaki |
| 8,490,628 | B2 | 7/2013 | Hon |
| 8,511,318 | B2 | 8/2013 | Hon |
| 8,678,013 | B2 | 3/2014 | Crooks et al. |
| 8,689,804 | B2 | 4/2014 | Fernando |
| 8,689,805 | B2 | 4/2014 | Hon |
| 8,701,682 | B2 | 4/2014 | Sherwood |
| 8,707,967 | B2 | 4/2014 | Li |
| 8,752,545 | B2 | 6/2014 | Buchberger |
| 8,757,404 | B1 | 6/2014 | Fleckenstein |
| 8,807,140 | B1 | 8/2014 | Scatterday |
| 8,833,364 | B2 | 9/2014 | Buchberger |
| 8,899,238 | B2 | 12/2014 | Robinson et al. |
| 8,948,578 | B2 | 2/2015 | Buchberger |
| 9,060,388 | B2 | 6/2015 | Liu |
| 9,084,440 | B2 | 7/2015 | Zuber |
| 9,125,437 | B2 | 9/2015 | Kaljura |
| 9,302,522 | B2 | 4/2016 | Sherwood |
| 9,357,803 | B2 | 6/2016 | Egoyants et al. |
| 9,414,619 | B2 | 8/2016 | Sizer et al. |
| 9,414,629 | B2 | 8/2016 | Egoyants et al. |
| 9,439,454 | B2 | 9/2016 | Fernando |
| 9,554,598 | B2 | 1/2017 | Egoyants et al. |
| 9,609,894 | B2 | 4/2017 | Abramov et al. |
| 9,623,205 | B2 | 4/2017 | Buchberger |
| 9,668,516 | B2 | 6/2017 | Sherwood |
| 9,693,587 | B2 | 7/2017 | Plojoux et al. |
| 9,955,726 | B2 | 5/2018 | Brinkley |
| 9,980,523 | B2 | 5/2018 | Abramov et al. |
| 9,999,256 | B2 | 6/2018 | Abramov et al. |
| 10,010,695 | B2 | 7/2018 | Buchberger |
| 10,045,562 | B2 | 8/2018 | Buchberger |
| 10,130,121 | B2 | 11/2018 | Plojoux et al. |
| 10,130,780 | B2 | 11/2018 | Talon |
| 10,524,516 | B2 | 1/2020 | Alelov |
| 10,588,337 | B2 | 3/2020 | Prestia et al. |
| 10,881,138 | B2 | 1/2021 | Saleem et al. |
| 10,881,141 | B2 | 1/2021 | Fraser et al. |
| 2001/0042546 | A1 | 11/2001 | Umeda et al. |
| 2001/0042927 | A1 | 11/2001 | Rock |
| 2001/0054421 | A1 | 12/2001 | Jaser et al. |
| 2002/0005207 | A1 | 1/2002 | Wrenn et al. |
| 2002/0016370 | A1 | 2/2002 | Shytle et al. |
| 2002/0043260 | A1 | 4/2002 | Layer et al. |
| 2002/0078951 | A1 | 6/2002 | Nichols et al. |
| 2002/0078955 | A1 | 6/2002 | Nichols et al. |
| 2002/0078956 | A1 | 6/2002 | Sharpe et al. |
| 2002/0079309 | A1 | 6/2002 | Cox et al. |
| 2002/0079377 | A1 | 6/2002 | Nichols |
| 2002/0089072 | A1 | 7/2002 | Rock |
| 2002/0121624 | A1 | 9/2002 | Usui |
| 2002/0170666 | A1 | 11/2002 | Tathgur et al. |
| 2003/0005620 | A1 | 1/2003 | Ananth et al. |
| 2003/0007887 | A1 | 1/2003 | Roumpos et al. |
| 2003/0049025 | A1 | 3/2003 | Neumann et al. |
| 2003/0052196 | A1 | 3/2003 | Fuchs |
| 2003/0079309 | A1 | 5/2003 | Vandenbelt et al. |
| 2003/0097164 | A1 | 5/2003 | Stapf et al. |
| 2003/0101984 | A1 | 6/2003 | Li et al. |
| 2003/0105192 | A1 | 6/2003 | Li et al. |
| 2003/0106551 | A1 | 6/2003 | Sprinkel et al. |
| 2003/0106552 | A1 | 6/2003 | Sprinkel, Jr. et al. |
| 2003/0108342 | A1 | 6/2003 | Sherwood et al. |
| 2003/0111637 | A1 | 6/2003 | Li et al. |
| 2003/0146224 | A1 | 8/2003 | Fujii et al. |
| 2003/0159702 | A1 | 8/2003 | Lindell et al. |
| 2003/0200964 | A1 | 10/2003 | Blakley et al. |
| 2003/0202169 | A1 | 10/2003 | Liu |
| 2003/0209240 | A1 | 11/2003 | Hale et al. |
| 2003/0217750 | A1 | 11/2003 | Amirpour et al. |
| 2003/0226837 | A1 | 12/2003 | Blake et al. |
| 2003/0230567 | A1 | 12/2003 | Centanni et al. |
| 2004/0003820 | A1 | 1/2004 | Iannuzzi |
| 2004/0031485 | A1 | 2/2004 | Rustad et al. |
| 2004/0031495 | A1 | 2/2004 | Steinberg |
| 2004/0065314 | A1 | 4/2004 | Layer et al. |
| 2004/0068222 | A1 | 4/2004 | Brian |
| 2004/0083755 | A1 | 5/2004 | Kolowich |
| 2004/0096204 | A1 | 5/2004 | Gerhardinger |
| 2004/0129793 | A1 | 7/2004 | Nguyen et al. |
| 2004/0149296 | A1 | 8/2004 | Rostami et al. |
| 2004/0149297 | A1 | 8/2004 | Sharpe |
| 2004/0149737 | A1 | 8/2004 | Sharpe et al. |
| 2004/0177849 | A1 | 9/2004 | Del |
| 2004/0210151 | A1 | 10/2004 | Tsukashima et al. |
| 2004/0226568 | A1 | 11/2004 | Takeuchi et al. |
| 2004/0234699 | A1 | 11/2004 | Hale et al. |
| 2004/0234914 | A1 | 11/2004 | Hale et al. |
| 2004/0234916 | A1 | 11/2004 | Hale et al. |
| 2004/0255941 | A1 | 12/2004 | Nichols et al. |
| 2004/0261782 | A1 | 12/2004 | Furumichi et al. |
| 2005/0007870 | A1 | 1/2005 | Faraldi et al. |
| 2005/0016549 | A1 | 1/2005 | Banerjee et al. |
| 2005/0025213 | A1 | 2/2005 | Parks |
| 2005/0031798 | A1 | 2/2005 | Tathgur et al. |
| 2005/0045193 | A1 | 3/2005 | Yang |
| 2005/0063686 | A1 | 3/2005 | Whittle et al. |
| 2005/0066735 | A1 | 3/2005 | Beavis et al. |
| 2005/0079166 | A1 | 4/2005 | Damani et al. |
| 2005/0098187 | A1 | 5/2005 | Grierson |
| 2005/0133029 | A1 | 6/2005 | Nichols et al. |
| 2005/0145260 | A1 | 7/2005 | Inagaki et al. |
| 2005/0194013 | A1 | 9/2005 | Wright |
| 2005/0196345 | A1 | 9/2005 | Diederichs et al. |
| 2005/0204799 | A1 | 9/2005 | Koch |
| 2005/0211711 | A1 | 9/2005 | Reid |
| 2005/0236006 | A1 | 10/2005 | Cowan |
| 2005/0268911 | A1 | 12/2005 | Cross et al. |
| 2006/0027233 | A1 | 2/2006 | Zierenberg et al. |
| 2006/0032501 | A1 | 2/2006 | Hale et al. |
| 2006/0043067 | A1 | 3/2006 | Kadkhodayan et al. |
| 2006/0078477 | A1 | 4/2006 | Althouse et al. |
| 2006/0102175 | A1 | 5/2006 | Nelson |
| 2006/0118128 | A1 | 6/2006 | Hoffmann et al. |
| 2006/0137681 | A1 | 6/2006 | Von Hollen et al. |
| 2006/0191546 | A1 | 8/2006 | Takano et al. |
| 2006/0196518 | A1 | 9/2006 | Hon |
| 2006/0196885 | A1 | 9/2006 | Leach et al. |
| 2006/0255029 | A1 | 11/2006 | Bone, Jr. |
| 2007/0014549 | A1 | 1/2007 | Demarest et al. |
| 2007/0023043 | A1 | 2/2007 | Von Hollen et al. |
| 2007/0028916 | A1 | 2/2007 | Hale et al. |
| 2007/0031340 | A1 | 2/2007 | Hale et al. |
| 2007/0045288 | A1 | 3/2007 | Nelson |
| 2007/0062548 | A1 | 3/2007 | Horstmann et al. |
| 2007/0074734 | A1 | 4/2007 | Braunshteyn et al. |
| 2007/0102013 | A1 | 5/2007 | Adams et al. |

(56) References Cited

U.S. PATENT DOCUMENTS

2007/0102533 A1 5/2007 Rosell et al.
2007/0107879 A1 5/2007 Radomski et al.
2007/0125362 A1 6/2007 Ford et al.
2007/0131219 A1 6/2007 Ford et al.
2007/0138207 A1 6/2007 Bonney et al.
2007/0155255 A1 7/2007 Galauner et al.
2007/0175476 A1 8/2007 Lipowicz
2007/0204858 A1 9/2007 Abelbeck
2007/0204864 A1 9/2007 Grychowski et al.
2007/0204868 A1 9/2007 Bollinger et al.
2007/0222112 A1 9/2007 Christ et al.
2007/0235046 A1 10/2007 Gedevanishvili
2007/0267407 A1 11/2007 Loveless et al.
2007/0283972 A1 12/2007 Monsees et al.
2007/0289720 A1 12/2007 Sunol et al.
2008/0027694 A1 1/2008 Gitman
2008/0031267 A1 2/2008 Imao
2008/0038363 A1 2/2008 Zaffaroni et al.
2008/0085139 A1 4/2008 Roof
2008/0092912 A1 4/2008 Robinson et al.
2008/0149118 A1 6/2008 Oglesby et al.
2008/0149622 A1 6/2008 Weiss et al.
2008/0156326 A1 7/2008 Belcastro et al.
2008/0216828 A1 9/2008 Wensley et al.
2008/0233318 A1 9/2008 Coyle
2008/0241255 A1 10/2008 Rose et al.
2008/0257367 A1 10/2008 Paterno et al.
2008/0276947 A1 11/2008 Martzel
2008/0302374 A1 12/2008 Wengert et al.
2008/0312674 A1 12/2008 Chen et al.
2009/0015717 A1 1/2009 Arnao et al.
2009/0032034 A1 2/2009 Steinberg
2009/0056728 A1 3/2009 Baker
2009/0065011 A1 3/2009 Maeder et al.
2009/0071477 A1 3/2009 Hale et al.
2009/0078711 A1 3/2009 Farone et al.
2009/0090349 A1 4/2009 Donovan
2009/0090351 A1 4/2009 Sunol et al.
2009/0090472 A1 4/2009 Radomski
2009/0095287 A1 4/2009 Emarlou
2009/0095311 A1 4/2009 Han
2009/0107492 A1 4/2009 Ooida
2009/0114215 A1 5/2009 Boeck et al.
2009/0126745 A1 5/2009 Hon
2009/0127253 A1 5/2009 Stark et al.
2009/0151717 A1* 6/2009 Bowen ..... A61M 11/048 128/200.23
2009/0162294 A1 6/2009 Werner
2009/0180968 A1 7/2009 Hale et al.
2009/0188490 A1 7/2009 Han
2009/0199843 A1 8/2009 Farone et al.
2009/0217923 A1 9/2009 Boehm et al.
2009/0230117 A1 9/2009 Fernando et al.
2009/0241947 A1 10/2009 Bedini et al.
2009/0255923 A1 10/2009 Buehrer et al.
2009/0260641 A1 10/2009 Monsees et al.
2009/0260642 A1 10/2009 Monsees et al.
2009/0272379 A1 11/2009 Thorens et al.
2009/0280043 A1 11/2009 Ferguson
2009/0293892 A1 12/2009 Williams et al.
2009/0301363 A1 12/2009 Damani et al.
2009/0301471 A1 12/2009 Stirzel
2009/0302019 A1 12/2009 Selenski et al.
2009/0304372 A1 12/2009 Gubler et al.
2010/0006092 A1 1/2010 Hale et al.
2010/0025023 A1 2/2010 Schmidt et al.
2010/0031968 A1 2/2010 Sheikh et al.
2010/0043809 A1 2/2010 Magnon
2010/0059070 A1 3/2010 Potter et al.
2010/0065052 A1 3/2010 Sharma et al.
2010/0065653 A1 3/2010 Wingo et al.
2010/0068154 A1 3/2010 Sharma et al.
2010/0083959 A1 4/2010 Siller
2010/0089381 A1 4/2010 Bolmer et al.
2010/0108059 A1 5/2010 Axelsson et al.
2010/0126516 A1 5/2010 Yomtov et al.
2010/0147299 A1 6/2010 Row et al.
2010/0181387 A1 7/2010 Zaffaroni et al.
2010/0200006 A1 8/2010 Robinson et al.
2010/0236546 A1 9/2010 Yamada et al.
2010/0242974 A1 9/2010 Pan
2010/0242975 A1 9/2010 Hearn
2010/0258585 A1 10/2010 Jamison
2010/0268212 A1 10/2010 Manwaring
2010/0300467 A1 12/2010 Kuistila et al.
2010/0307518 A1 12/2010 Wang
2010/0313901 A1 12/2010 Fernando et al.
2011/0005535 A1 1/2011 Xiu
2011/0011396 A1 1/2011 Fang
2011/0030671 A1 2/2011 Ferguson et al.
2011/0036363 A1 2/2011 Urtsev et al.
2011/0090266 A1 4/2011 King et al.
2011/0094523 A1 4/2011 Thorens et al.
2011/0120989 A1 5/2011 Schilling et al.
2011/0126848 A1 6/2011 Zuber et al.
2011/0155153 A1 6/2011 Thorens et al.
2011/0155718 A1 6/2011 Greim et al.
2011/0192408 A1 8/2011 Inagaki et al.
2011/0192914 A1 8/2011 Ishigami
2011/0226236 A1 9/2011 Buchberger
2011/0240022 A1 10/2011 Hodges et al.
2011/0264084 A1 10/2011 Reid
2011/0277757 A1 11/2011 Terry et al.
2011/0283458 A1 11/2011 Gillette et al.
2011/0290266 A1 12/2011 Koeller
2011/0290267 A1 12/2011 Yamada et al.
2011/0297166 A1 12/2011 Takeuchi et al.
2011/0303230 A1 12/2011 Thiry
2011/0303231 A1 12/2011 Li et al.
2012/0006342 A1 1/2012 Rose et al.
2012/0006343 A1 1/2012 Renaud et al.
2012/0132196 A1 5/2012 Vladyslavovych
2012/0145169 A1 6/2012 Wu
2012/0145189 A1 6/2012 Knopow et al.
2012/0234315 A1* 9/2012 Li ..... A24F 40/465 128/200.21
2012/0234821 A1 9/2012 Shimizu
2012/0255546 A1 10/2012 Goetz et al.
2012/0260927 A1 10/2012 Liu
2012/0285476 A1 11/2012 Hon
2013/0042865 A1 2/2013 Monsees et al.
2013/0061861 A1 3/2013 Hearn
2013/0074857 A1 3/2013 Buchberger
2013/0081623 A1 4/2013 Buchberger
2013/0087160 A1 4/2013 Gherghe
2013/0133675 A1 5/2013 Shinozaki et al.
2013/0142782 A1 6/2013 Rahmel et al.
2013/0152922 A1 6/2013 Benassayag et al.
2013/0192615 A1 8/2013 Tucker et al.
2013/0213419 A1 8/2013 Tucker et al.
2013/0284192 A1 10/2013 Peleg et al.
2013/0306084 A1 11/2013 Flick
2013/0333700 A1 12/2013 Buchberger
2013/0340779 A1 12/2013 Liu
2014/0000638 A1 1/2014 Sebastian et al.
2014/0060528 A1 3/2014 Liu
2014/0060554 A1 3/2014 Collett et al.
2014/0060555 A1 3/2014 Chang et al.
2014/0096781 A1 4/2014 Sears et al.
2014/0182608 A1 7/2014 Egoyants et al.
2014/0182843 A1 7/2014 Vinegar
2014/0196716 A1 7/2014 Liu
2014/0202454 A1 7/2014 Buchberger
2014/0202476 A1 7/2014 Egoyants et al.
2014/0209105 A1 7/2014 Sears et al.
2014/0216482 A1 8/2014 Dolan
2014/0216485 A1 8/2014 Egoyants et al.
2014/0238396 A1 8/2014 Buchberger
2014/0238423 A1 8/2014 Tucker et al.
2014/0238424 A1 8/2014 Macko et al.
2014/0238737 A1 8/2014 Backman
2014/0261490 A1 9/2014 Kane
2014/0270726 A1 9/2014 Egoyants et al.
2014/0270730 A1 9/2014 DePiano et al.

(56) References Cited

U.S. PATENT DOCUMENTS

2014/0283825 A1 9/2014 Buchberger
2014/0286630 A1 9/2014 Buchberger
2014/0299125 A1 10/2014 Buchberger
2014/0305449 A1 10/2014 Plojoux et al.
2014/0326257 A1 11/2014 Jalloul et al.
2014/0334802 A1 11/2014 Dubief
2014/0338680 A1 11/2014 Abramov et al.
2014/0360515 A1 12/2014 Vasiliev et al.
2015/0020825 A1 1/2015 Galloway et al.
2015/0040925 A1 2/2015 Saleem et al.
2015/0114411 A1 4/2015 Buchberger
2015/0142088 A1 5/2015 Riva Godoy
2015/0157055 A1 6/2015 Lord
2015/0157756 A1 6/2015 Duffield et al.
2015/0196058 A1 7/2015 Lord
2015/0208728 A1 7/2015 Lord
2015/0223520 A1 8/2015 Phillips et al.
2015/0245669 A1 9/2015 Cadieux et al.
2015/0272219 A1* 10/2015 Hatrick ..... A24F 40/465
131/328
2015/0282256 A1 10/2015 Iguro et al.
2015/0302971 A1 10/2015 Wagman et al.
2015/0320116 A1 11/2015 Bleloch et al.
2016/0003403 A1 1/2016 Smith
2016/0036222 A1 2/2016 Templeton et al.
2016/0044963 A1 2/2016 Saleem
2016/0073693 A1 3/2016 Reevell
2016/0088685 A1 3/2016 Henke et al.
2016/0106154 A1 4/2016 Lord
2016/0106155 A1 4/2016 Reevell
2016/0146506 A1 5/2016 Brereton et al.
2016/0150825 A1 6/2016 Mironov
2016/0150828 A1 6/2016 Goldstein et al.
2016/0168438 A1 6/2016 Harding et al.
2016/0248280 A1 8/2016 Ben-Shalom et al.
2016/0255879 A1 9/2016 Paprocki et al.
2016/0295921 A1 10/2016 Mironov et al.
2017/0006916 A1 1/2017 Liu
2017/0042245 A1 2/2017 Buchberger et al.
2017/0055574 A1 3/2017 Kaufman et al.
2017/0055575 A1 3/2017 Wilke et al.
2017/0055580 A1 3/2017 Blandino et al.
2017/0055581 A1 3/2017 Wilke et al.
2017/0055582 A1 3/2017 Blandino et al.
2017/0055583 A1 3/2017 Blandino et al.
2017/0055584 A1 3/2017 Blandino et al.
2017/0071250 A1 3/2017 Mironov
2017/0079325 A1 3/2017 Mironov
2017/0086508 A1 3/2017 Mironov et al.
2017/0095006 A1 4/2017 Egoyants et al.
2017/0119046 A1 5/2017 Kaufman et al.
2017/0119047 A1 5/2017 Blandino et al.
2017/0119048 A1 5/2017 Kaufman et al.
2017/0119049 A1 5/2017 Blandino et al.
2017/0119050 A1 5/2017 Blandino et al.
2017/0119051 A1 5/2017 Blandino et al.
2017/0119054 A1 5/2017 Zinovik et al.
2017/0156403 A1 6/2017 Gill et al.
2017/0156406 A1 6/2017 Abramov et al.
2017/0156407 A1 6/2017 Abramov et al.
2017/0197043 A1 7/2017 Buchberger
2017/0197044 A1 7/2017 Buchberger
2017/0197046 A1 7/2017 Buchberger
2017/0197048 A1 7/2017 Khosrowshahi et al.
2017/0197049 A1 7/2017 Doll
2017/0197050 A1 7/2017 Reinburg et al.
2017/0231281 A1 8/2017 Hatton et al.
2017/0303585 A1 10/2017 Florack et al.
2017/0332700 A1 11/2017 Plews et al.
2017/0340008 A1 11/2017 Sebastian et al.
2018/0184713 A1 7/2018 Mironov et al.
2018/0192700 A1 7/2018 Fraser et al.
2018/0214645 A1 8/2018 Reevell
2018/0235279 A1 8/2018 Wilke
2018/0242633 A1 8/2018 Wilke et al.
2018/0242636 A1 8/2018 Blandino
2018/0249760 A1 9/2018 Kaufman et al.
2018/0271171 A1 9/2018 Abramov et al.
2018/0317552 A1 11/2018 Kaufman
2018/0317553 A1 11/2018 Blandino
2018/0317554 A1 11/2018 Kaufman et al.
2018/0317555 A1 11/2018 Blandino
2018/0325173 A1 11/2018 Blandino et al.
2019/0000142 A1 1/2019 Lavanchy et al.
2019/0014820 A1 1/2019 Malgat
2019/0082738 A1 3/2019 Blandino et al.
2019/0191780 A1 6/2019 Wilke et al.
2019/0230988 A1 8/2019 Aoun
2019/0239555 A1 8/2019 Nicholson
2019/0313695 A1 10/2019 Kaufman et al.
2019/0364973 A1 12/2019 Kaufman
2020/0054068 A1 2/2020 Blandino et al.
2020/0054069 A1 2/2020 Blandino et al.
2020/0229497 A1 7/2020 Aoun et al.
2020/0268053 A1 8/2020 Thorsen et al.
2020/0288774 A1 9/2020 Blandino et al.
2020/0352237 A1 11/2020 Kaufman et al.
2021/0093008 A1 4/2021 White et al.
2021/0093012 A1 4/2021 White et al.
2021/0137167 A1 5/2021 Aoun et al.
2021/0186109 A1 6/2021 Milligan et al.

FOREIGN PATENT DOCUMENTS

AT 321190 B 3/1975
AT 321191 B 3/1975
AT 507187 B1 3/2010
AT 508244 A4 12/2010
AT 510405 A4 4/2012
AT 510504 A1 4/2012
AU 6393173 A 6/1975
AU 2002364521 A1 6/2003
AU 2018241908 B2 9/2020
AU 2020281092 A1 1/2021
CA 2160990 A1 10/1994
CA 2146954 A1 10/1996
CA 2309376 A1 11/2000
CA 2414161 A1 1/2002
CA 2414191 A1 1/2002
CA 2520759 A1 10/2004
CA 2492255 A1 7/2006
CA 2668465 A1 12/2009
CA 2712412 A1 12/2009
CA 2641869 A1 5/2010
CA 2862048 A1 7/2013
CA 2923377 A1 6/2015
CA 2989375 A1 1/2017
CH 513656 A 10/1971
CH 698603 B1 9/2009
CL 199400288 A1 8/1995
CL 2007002226 A1 2/2008
CL 2013003637 A1 7/2014
CL 2014002840 A1 12/2014
CL 2017003408 A1 6/2018
CN 86102917 A 11/1987
CN 1038085 A 12/1989
CN 1040914 A 4/1990
CN 1043076 A 6/1990
CN 1045691 A 10/1990
CN 2092880 U 1/1992
CN 1059649 A 3/1992
CN 2144261 Y 10/1993
CN 1106812 A 8/1995
CN 2220168 Y 2/1996
CN 1121385 4/1996
CN 1122213 A 5/1996
CN 1123000 A 5/1996
CN 1123001 A 5/1996
CN 1126426 A 7/1996
CN 2246744 Y 2/1997
CN 1158757 A 9/1997
CN 1195270 A 10/1998
CN 1196660 A 10/1998
CN 1196661 A 10/1998

(56) References Cited

FOREIGN PATENT DOCUMENTS

| | | | | |
|---|---|---|---|---|
| CN | 1205849 | A | 1/1999 | |
| CN | 1209731 | A | 3/1999 | |
| CN | 1287890 | A | 3/2001 | |
| CN | 1293591 | A | 5/2001 | |
| CN | 1293596 | A | 5/2001 | |
| CN | 1312730 | A | 9/2001 | |
| CN | 1106812 | C | 4/2003 | |
| CN | 1130109 | C | 12/2003 | |
| CN | 1130137 | C | 12/2003 | |
| CN | 2598364 | Y | 1/2004 | |
| CN | 1495417 | A | 5/2004 | |
| CN | 1151739 | C | 6/2004 | |
| CN | 1545823 | A | 11/2004 | |
| CN | 1575135 | A | 2/2005 | |
| CN | 1578895 | A | 2/2005 | |
| CN | 1641976 | A | 7/2005 | |
| CN | 2719043 | Y | 8/2005 | |
| CN | 1679419 | A | 10/2005 | |
| CN | 1694765 | A | 11/2005 | |
| CN | 1703279 | A | 11/2005 | |
| CN | 200966824 | Y | 10/2007 | |
| CN | 201076006 | Y | 6/2008 | |
| CN | 101238047 | A | 8/2008 | |
| CN | 101267749 | A | 9/2008 | |
| CN | 101277622 | A | 10/2008 | |
| CN | 101282660 | A | 10/2008 | |
| CN | 201185656 | Y | 1/2009 | |
| CN | 101390659 | A | 3/2009 | |
| CN | 201199922 | Y | 3/2009 | |
| CN | 201238609 | Y | 5/2009 | |
| CN | 101500443 | A | 8/2009 | |
| CN | 101516425 | A | 8/2009 | |
| CN | 101557728 | A | 10/2009 | |
| CN | 201375023 | Y | 1/2010 | |
| CN | 101648041 | A | 2/2010 | |
| CN | 201445686 | | 5/2010 | |
| CN | 101878958 | A | 11/2010 | |
| CN | 101925309 | A | 12/2010 | |
| CN | 102014677 | A | 4/2011 | |
| CN | 201869778 | U | 6/2011 | |
| CN | 102131411 | A | 7/2011 | |
| CN | 102186271 | A | 9/2011 | |
| CN | 102212340 | A | 10/2011 | |
| CN | 202172846 | U | 3/2012 | |
| CN | 102483237 | A | 5/2012 | |
| CN | 102499466 | A | 6/2012 | |
| CN | 102539005 | A | 7/2012 | |
| CN | 102575954 | A | 7/2012 | |
| CN | 102604599 | A | 7/2012 | |
| CN | 202351223 | U | 7/2012 | |
| CN | 102655773 | A | 9/2012 | |
| CN | 202722498 | U | 2/2013 | |
| CN | 202750708 | U | 2/2013 | |
| CN | 103052380 | A | 4/2013 | |
| CN | 103054196 | A | 4/2013 | |
| CN | 103202540 | A | 7/2013 | |
| CN | 103359550 | A | 10/2013 | |
| CN | 203369386 | U | 1/2014 | |
| CN | 103608619 | A | 2/2014 | |
| CN | 103689812 | A | 4/2014 | |
| CN | 103689815 | A | 4/2014 | |
| CN | 103763954 | A | 4/2014 | |
| CN | 103974640 | A | 8/2014 | |
| CN | 103997922 | A | 8/2014 | |
| CN | 104010531 | A | 8/2014 | |
| CN | 203748673 | U | 8/2014 | |
| CN | 203761188 | U | 8/2014 | |
| CN | 203762288 | U | 8/2014 | |
| CN | 104039183 | A | 9/2014 | |
| CN | 104095291 | A | 10/2014 | |
| CN | 104095293 | A | 10/2014 | |
| CN | 104095295 | A | 10/2014 | |
| CN | 203952405 | * | 11/2014 | ..... A24F 40/465 |
| CN | 203952405 | U | 11/2014 | |
| CN | 104203016 | A | 12/2014 | |
| CN | 104223359 | A | 12/2014 | |
| CN | 203986095 | U | 12/2014 | |
| CN | 104256899 | | 1/2015 | |
| CN | 204091003 | U | 1/2015 | |
| CN | 104540406 | A | 4/2015 | |
| CN | 104619202 | | 5/2015 | |
| CN | 104664608 | A | 6/2015 | |
| CN | 104677116 | A | 6/2015 | |
| CN | 104703308 | A | 6/2015 | |
| CN | 104720121 | A | 6/2015 | |
| CN | 204440191 | U | 7/2015 | |
| CN | 204519365 | U | 8/2015 | |
| CN | 204539505 | U | 8/2015 | |
| CN | 204599333 | U | 9/2015 | |
| CN | 204949521 | U | 1/2016 | |
| CN | 105307524 | A | 2/2016 | |
| CN | 105307525 | A | 2/2016 | |
| CN | 106102863 | A | 11/2016 | |
| CN | 106455712 | A | 2/2017 | |
| CN | 106617325 | A | 5/2017 | |
| CN | 109330030 | A | 2/2019 | |
| DE | 360431 | C | 10/1922 | |
| DE | 1100884 | B | 3/1961 | |
| DE | 1425872 | A1 | 11/1968 | |
| DE | 1290499 | B | 3/1969 | |
| DE | 1813993 | A1 | 6/1970 | |
| DE | 1425871 | B1 | 10/1970 | |
| DE | 1950439 | A1 | 4/1971 | |
| DE | 2315789 | A1 | 10/1973 | |
| DE | 3148335 | A1 | 7/1983 | |
| DE | 3218760 | A1 | 12/1983 | |
| DE | 3936687 | A1 | 5/1990 | |
| DE | 4105370 | A1 | 8/1992 | |
| DE | 4307144 | C2 | 1/1995 | |
| DE | 4343578 | A1 | 6/1995 | |
| DE | 29509286 | U1 | 8/1995 | |
| DE | 4420366 | A1 | 12/1995 | |
| DE | 29700307 | U1 | 4/1997 | |
| DE | 29713866 | U1 | 10/1997 | |
| DE | 29719509 | U1 | 1/1998 | |
| DE | 19630619 | A1 | 2/1998 | |
| DE | 19654945 | A1 | 3/1998 | |
| DE | 19854007 | A1 | 5/2000 | |
| DE | 19854009 | A1 | 5/2000 | |
| DE | 10058642 | A1 | 6/2001 | |
| DE | 10007521 | A1 | 8/2001 | |
| DE | 10064288 | A1 | 8/2001 | |
| DE | 10164587 | A1 | 7/2003 | |
| DE | 10330681 | B3 | 6/2004 | |
| DE | 102005024803 | A1 | 6/2006 | |
| DE | 202006013439 | U1 | 10/2006 | |
| DE | 102005023278 | A1 | 11/2006 | |
| DE | 102005056885 | A1 | 5/2007 | |
| DE | 102006041544 | A1 | 8/2007 | |
| DE | 102006041042 | A1 | 3/2008 | |
| DE | 102006047146 | A1 | 4/2008 | |
| DE | 102007011120 | A1 | 9/2008 | |
| DE | 102008034509 | A1 | 4/2009 | |
| DE | 102008013303 | A1 | 9/2009 | |
| DE | 202009010400 | U1 | 11/2009 | |
| DE | 102008038121 | A1 | 2/2010 | |
| DE | 202010011436 | U1 | 11/2010 | |
| DE | 102009047185 | A1 | 6/2011 | |
| DE | 102010046482 | A1 | 3/2012 | |
| DE | 202013100606 | U1 | 2/2013 | |
| DE | 102013002555 | A1 | 6/2014 | |
| DK | 114399 | B | 6/1969 | |
| DK | 488488 | A | 3/1989 | |
| DK | 0540774 | T3 | 7/1995 | |
| DK | 0540775 | T3 | 8/1997 | |
| EP | 0033668 | A1 | 8/1981 | |
| EP | 0076897 | A1 | 4/1983 | |
| EP | 0033668 | B1 | 6/1983 | |
| EP | 0149997 | A2 | 7/1985 | |
| EP | 0194257 | A1 | 9/1986 | |
| EP | 0280262 | A2 | 8/1988 | |
| EP | 0295122 | A2 | 12/1988 | |
| EP | 0309227 | A2 | 3/1989 | |
| EP | 0358002 | A2 | 3/1990 | |

(56) References Cited

FOREIGN PATENT DOCUMENTS

| | | | |
|---|---|---|---|
| EP | 0358114 | A2 | 3/1990 |
| EP | 0371285 | A2 | 6/1990 |
| EP | 0418464 | A2 | 3/1991 |
| EP | 0430559 | A2 | 6/1991 |
| EP | 0430566 | A2 | 6/1991 |
| EP | 0438862 | A2 | 7/1991 |
| EP | 0444553 | A2 | 9/1991 |
| EP | 0488488 | A1 | 6/1992 |
| EP | 0491952 | A1 | 7/1992 |
| EP | 0503767 | A1 | 9/1992 |
| EP | 0503794 | A1 | 9/1992 |
| EP | 0520231 | A2 | 12/1992 |
| EP | 0603613 | A1 | 6/1994 |
| EP | 0430559 | B1 | 3/1995 |
| EP | 0703735 | A1 | 4/1996 |
| EP | 0354661 | B1 | 4/1997 |
| EP | 0540775 | B1 | 7/1997 |
| EP | 0823492 | A2 | 2/1998 |
| EP | 0824927 | A2 | 2/1998 |
| EP | 0845220 | A1 | 6/1998 |
| EP | 0857431 | A1 | 8/1998 |
| EP | 0653218 | B1 | 9/1998 |
| EP | 0893071 | A1 | 1/1999 |
| EP | 1064083 | A2 | 1/2001 |
| EP | 1064101 | A2 | 1/2001 |
| EP | 1111191 | A2 | 6/2001 |
| EP | 0703735 | B1 | 7/2001 |
| EP | 1128741 | A1 | 9/2001 |
| EP | 1128742 | A1 | 9/2001 |
| EP | 1128743 | A1 | 9/2001 |
| EP | 1148905 | A2 | 10/2001 |
| EP | 1166814 | A2 | 1/2002 |
| EP | 1166847 | A2 | 1/2002 |
| EP | 1203189 | A1 | 5/2002 |
| EP | 1217320 | A2 | 6/2002 |
| EP | 1298993 | A1 | 4/2003 |
| EP | 1299499 | A1 | 4/2003 |
| EP | 1299500 | A2 | 4/2003 |
| EP | 1301152 | A2 | 4/2003 |
| EP | 0845220 | B1 | 9/2003 |
| EP | 1349601 | A2 | 10/2003 |
| EP | 1357025 | A2 | 10/2003 |
| EP | 1390112 | A1 | 2/2004 |
| EP | 1409051 | A2 | 4/2004 |
| EP | 1439876 | A2 | 7/2004 |
| EP | 1454840 | A1 | 9/2004 |
| EP | 1490452 | A2 | 12/2004 |
| EP | 1506792 | A2 | 2/2005 |
| EP | 1609376 | A1 | 12/2005 |
| EP | 1618803 | A1 | 1/2006 |
| EP | 1625334 | A2 | 2/2006 |
| EP | 1625335 | A2 | 2/2006 |
| EP | 1625336 | A2 | 2/2006 |
| EP | 1454840 | B1 | 9/2006 |
| EP | 1536703 | B1 | 9/2006 |
| EP | 1702639 | A2 | 9/2006 |
| EP | 1736065 | A1 | 12/2006 |
| EP | 1749548 | A2 | 2/2007 |
| EP | 1757921 | A2 | 2/2007 |
| EP | 1867357 | A1 | 12/2007 |
| EP | 1891867 | A2 | 2/2008 |
| EP | 1940254 | A2 | 7/2008 |
| EP | 1996880 | A2 | 12/2008 |
| EP | 2011033 | A2 | 1/2009 |
| EP | 2018886 | A1 | 1/2009 |
| EP | 2022349 | A1 | 2/2009 |
| EP | 2044967 | A1 | 4/2009 |
| EP | 1357025 | B1 | 7/2009 |
| EP | 2083642 | A1 | 8/2009 |
| EP | 2110033 | A1 | 10/2009 |
| EP | 2110034 | A1 | 10/2009 |
| EP | 2113178 | A1 | 11/2009 |
| EP | 2138058 | A1 | 12/2009 |
| EP | 2138059 | A1 | 12/2009 |
| EP | 1947965 | B1 | 2/2010 |
| EP | 2179229 | A2 | 4/2010 |
| EP | 2191735 | A1 | 6/2010 |
| EP | 2227973 | A1 | 9/2010 |
| EP | 2234508 | A2 | 10/2010 |
| EP | 2241203 | A2 | 10/2010 |
| EP | 2138057 | B1 | 11/2010 |
| EP | 2246086 | A2 | 11/2010 |
| EP | 2249669 | A1 | 11/2010 |
| EP | 2253541 | A1 | 11/2010 |
| EP | 2257195 | A1 | 12/2010 |
| EP | 2277398 | A1 | 1/2011 |
| EP | 2303043 | A2 | 4/2011 |
| EP | 2316286 | A1 | 5/2011 |
| EP | 2327318 | A1 | 6/2011 |
| EP | 2330866 | A2 | 6/2011 |
| EP | 2340729 | A1 | 7/2011 |
| EP | 2340730 | A1 | 7/2011 |
| EP | 2368449 | A1 | 9/2011 |
| EP | 2003997 | B1 | 10/2011 |
| EP | 2394520 | A1 | 12/2011 |
| EP | 2408494 | A1 | 1/2012 |
| EP | 2444112 | A1 | 4/2012 |
| EP | 2253541 | B1 | 5/2012 |
| EP | 2472185 | A1 | 7/2012 |
| EP | 2512205 | A1 | 10/2012 |
| EP | 2520186 | A1 | 11/2012 |
| EP | 2523752 | A1 | 11/2012 |
| EP | 2542131 | A2 | 1/2013 |
| EP | 2645814 | A1 | 10/2013 |
| EP | 2696652 | A1 | 2/2014 |
| EP | 2698070 | A1 | 2/2014 |
| EP | 2760303 | A2 | 8/2014 |
| EP | 2762019 | A1 | 8/2014 |
| EP | 2785208 | A1 | 10/2014 |
| EP | 2835062 | A1 | 2/2015 |
| EP | 2907397 | A1 | 8/2015 |
| EP | 2967156 | A1 | 1/2016 |
| EP | 2975958 | A1 | 1/2016 |
| EP | 2996504 | A1 | 3/2016 |
| EP | 2967156 | B1 | 11/2016 |
| EP | 2996504 | B1 | 11/2016 |
| EP | 3367828 | A1 | 9/2018 |
| ES | 262308 | U | 6/1982 |
| FR | 718708 | A | 1/1932 |
| FR | 960469 | A | 4/1950 |
| FR | 1418189 | A | 11/1965 |
| FR | 2573985 | A1 | 6/1986 |
| FR | 2604093 | A1 | 3/1988 |
| FR | 2700697 | A1 | 7/1994 |
| FR | 2730166 | A1 | 8/1996 |
| FR | 2818152 | A1 | 6/2002 |
| FR | 2842791 | B1 | 4/2005 |
| FR | 2873584 | B1 | 11/2006 |
| GB | 25575 | A | 3/1912 |
| GB | 191126138 | A | 3/1912 |
| GB | 347650 | A | 4/1931 |
| GB | 353745 | A | 7/1931 |
| GB | 426247 | A | 3/1935 |
| GB | 910166 | A | 11/1962 |
| GB | 922310 | A | 3/1963 |
| GB | 958867 | A | 5/1964 |
| GB | 1104214 | A | 2/1968 |
| GB | 1227333 | A | 4/1971 |
| GB | 1313525 | A | 4/1973 |
| GB | 1379688 | A | 1/1975 |
| GB | 1431334 | A | 4/1976 |
| GB | 2294401 | A | 5/1996 |
| GB | 2323033 | A | 9/1998 |
| GB | 2342874 | A | 4/2000 |
| GB | 2388040 | A | 11/2003 |
| GB | 2412326 | A | 9/2005 |
| GB | 2412876 | A | 10/2005 |
| GB | 2448478 | A | 10/2008 |
| GB | 2487851 | A | 8/2012 |
| GB | 2495923 | A | 5/2013 |
| GB | 2504732 | A | 2/2014 |
| HK | 1196511 | A1 | 12/2014 |
| HK | 1226611 | | 10/2017 |
| IE | 63083 | B1 | 3/1995 |

(56) References Cited

FOREIGN PATENT DOCUMENTS

| | | | |
|---|---|---|---|
| IT | 1289590 | B1 | 10/1998 |
| IT | RM20120193 | A1 | 8/2012 |
| JP | S4961986 | A | 6/1974 |
| JP | S5096908 | A | 8/1975 |
| JP | S5314173 | A | 2/1978 |
| JP | S5594260 | A | 7/1980 |
| JP | S5752456 | A | 3/1982 |
| JP | S57110260 | A | 7/1982 |
| JP | S57177769 | A | 11/1982 |
| JP | S59106340 | A | 6/1984 |
| JP | S6196763 | A | 5/1986 |
| JP | S6196765 | A | 5/1986 |
| JP | S62501050 | A | 4/1987 |
| JP | S62205184 | A | 9/1987 |
| JP | S6360322 | A | 3/1988 |
| JP | S63153666 | A | 6/1988 |
| JP | H01191674 | A | 8/1989 |
| JP | H01166953 | U | 11/1989 |
| JP | H0292986 | A | 4/1990 |
| JP | H0292988 | A | 4/1990 |
| JP | H02124081 | A | 5/1990 |
| JP | H02127493 | A | 5/1990 |
| JP | H02190171 | A | 7/1990 |
| JP | H034479 | A | 1/1991 |
| JP | H0341185 | A | 2/1991 |
| JP | H03112478 | A | 5/1991 |
| JP | H03192677 | A | 8/1991 |
| JP | H03232481 | A | 10/1991 |
| JP | H05103836 | A | 4/1993 |
| JP | H05115272 | A | 5/1993 |
| JP | H05193668 | A | 8/1993 |
| JP | H05212100 | A | 8/1993 |
| JP | H05309136 | A | 11/1993 |
| JP | H062164 | B1 | 1/1994 |
| JP | H06189861 | A | 7/1994 |
| JP | H06295782 | A | 10/1994 |
| JP | H06315366 | A | 11/1994 |
| JP | H07147965 | A | 6/1995 |
| JP | H08942 | U | 6/1996 |
| JP | 2519658 | B2 | 7/1996 |
| JP | H08228751 | A | 9/1996 |
| JP | H08299862 | A | 11/1996 |
| JP | H08511175 | A | 11/1996 |
| JP | H08511176 | A | 11/1996 |
| JP | H09107943 | A | 4/1997 |
| JP | H09257256 | A | 9/1997 |
| JP | 3044574 | U | 12/1997 |
| JP | 3053426 | U | 10/1998 |
| JP | H1189551 | A | 4/1999 |
| JP | H11503912 | A | 4/1999 |
| JP | H11125390 | A | 5/1999 |
| JP | H11169157 | A | 6/1999 |
| JP | H-11507234 | | 6/1999 |
| JP | H11178562 | A | 7/1999 |
| JP | H11514081 | A | 11/1999 |
| JP | 2000051556 | A | 2/2000 |
| JP | 3016586 | B2 | 3/2000 |
| JP | 20000082576 | | 3/2000 |
| JP | 2000119643 | A | 4/2000 |
| JP | 20000093155 | | 4/2000 |
| JP | 3078033 | B2 | 8/2000 |
| JP | 2000515576 | A | 11/2000 |
| JP | 3118462 | B2 | 12/2000 |
| JP | 3118463 | B2 | 12/2000 |
| JP | 2001063776 | A | 3/2001 |
| JP | 2002170657 | A | 6/2002 |
| JP | 2002527153 | A | 8/2002 |
| JP | 2002253593 | A | 9/2002 |
| JP | 2002529111 | A | 9/2002 |
| JP | 2002336290 | A | 11/2002 |
| JP | 2003034785 | A | 2/2003 |
| JP | 3413208 | B2 | 6/2003 |
| JP | 2004055547 | A | 2/2004 |
| JP | 2004504580 | A | 2/2004 |
| JP | 3588469 | B2 | 11/2004 |
| JP | 2004332069 | A | 11/2004 |
| JP | 2005036897 | A | 2/2005 |
| JP | 2005050624 | | 2/2005 |
| JP | 2005106350 | A | 4/2005 |
| JP | 2005516647 | A | 6/2005 |
| JP | 2005524067 | A | 8/2005 |
| JP | 2005300005 | A | 10/2005 |
| JP | 2005537918 | A | 12/2005 |
| JP | 2005537919 | A | 12/2005 |
| JP | 2005538149 | A | 12/2005 |
| JP | 2005538159 | A | 12/2005 |
| JP | 2006501871 | A | 1/2006 |
| JP | 2006219557 | A | 8/2006 |
| JP | 2006524494 | A | 11/2006 |
| JP | 2007057532 | A | 3/2007 |
| JP | 2007512880 | A | 5/2007 |
| JP | 2007516015 | A | 6/2007 |
| JP | 2007522900 | A | 8/2007 |
| JP | 2008035742 | A | 2/2008 |
| JP | 2008509907 | A | 4/2008 |
| JP | 2008511175 | A | 4/2008 |
| JP | 2008518614 | A | 6/2008 |
| JP | 2008249003 | A | 10/2008 |
| JP | 2008311058 | A | 12/2008 |
| JP | 2009501537 | A | 1/2009 |
| JP | 2009509523 | A | 3/2009 |
| JP | 2009087703 | A | 4/2009 |
| JP | 2009537119 | A | 10/2009 |
| JP | 2009537120 | A | 10/2009 |
| JP | 2010041354 | A | 2/2010 |
| JP | 2010506594 | A | 3/2010 |
| JP | 2010178730 | A | 8/2010 |
| JP | 2010526553 | A | 8/2010 |
| JP | 2010213579 | A | 9/2010 |
| JP | 2011058538 | A | 3/2011 |
| JP | 2011509667 | A | 3/2011 |
| JP | 2011515080 | A | 5/2011 |
| JP | 2011515093 | A | 5/2011 |
| JP | 2011113977 | A | 6/2011 |
| JP | 2011518567 | A | 6/2011 |
| JP | 2011135901 | A | 7/2011 |
| JP | 2011525366 | A | 9/2011 |
| JP | 2012506263 | A | 3/2012 |
| JP | 2012249854 | A | 12/2012 |
| JP | 2013054873 | A | 3/2013 |
| JP | 2013073939 | A | 4/2013 |
| JP | 5193668 | B2 | 5/2013 |
| JP | 2014519586 | A | 8/2014 |
| JP | 2014525251 | A | 9/2014 |
| JP | 2014526275 | A | 10/2014 |
| JP | 2014229498 | A | 12/2014 |
| JP | 2015503336 | A | 2/2015 |
| JP | 2015504667 | A | 2/2015 |
| JP | 2015060837 | A | 3/2015 |
| JP | 2015508287 | A | 3/2015 |
| JP | 2015509706 | A | 4/2015 |
| JP | 2015098645 | A | 5/2015 |
| JP | 2015513922 | A | 5/2015 |
| JP | 2015513970 | A | 5/2015 |
| JP | 2015531601 | A | 11/2015 |
| JP | 2016036222 | | 3/2016 |
| JP | 2016524777 | A | 8/2016 |
| JP | 2016525341 | A | 8/2016 |
| JP | 6217980 | B2 | 10/2017 |
| JP | 2017533732 | A | 11/2017 |
| JP | 2021508438 | A | 3/2021 |
| KR | 950700692 | A | 2/1995 |
| KR | 0178388 | B1 | 2/1999 |
| KR | 19990081973 | A | 11/1999 |
| KR | 100286488 | B1 | 4/2001 |
| KR | 100393327 | B1 | 10/2003 |
| KR | 200350504 | Y1 | 5/2004 |
| KR | 200370872 | Y1 | 12/2004 |
| KR | 100636287 | B1 | 10/2006 |
| KR | 20070038350 | A | 4/2007 |
| KR | 100757450 | B1 | 9/2007 |
| KR | 20070096027 | A | 10/2007 |
| KR | 20080060218 | A | 7/2008 |
| KR | 100971178 | B1 | 7/2010 |

(56) References Cited

FOREIGN PATENT DOCUMENTS

| | | | |
|---|---|---|---|
| KR | 20100135865 | A | 12/2010 |
| KR | 20120003484 | U | 5/2012 |
| KR | 20120104533 | A | 9/2012 |
| KR | 20130029697 | A | 3/2013 |
| KR | 20130006714 | U | 11/2013 |
| KR | 20150143877 | A | 12/2015 |
| KR | 20150143891 | A | 12/2015 |
| MX | 2009001096 | A | 3/2009 |
| MX | 2014011283 | A | 10/2014 |
| RU | 2066337 | C1 | 9/1996 |
| RU | 2098446 | C1 | 12/1997 |
| RU | 2135054 | C1 | 8/1999 |
| RU | 2285028 | C1 | 10/2006 |
| RU | 2311859 | C2 | 12/2007 |
| RU | 2336001 | C2 | 10/2008 |
| RU | 2349234 | C2 | 3/2009 |
| RU | 89927 | U1 | 12/2009 |
| RU | 94815 | U1 | 6/2010 |
| RU | 103281 | U1 | 4/2011 |
| RU | 115629 | U1 | 5/2012 |
| RU | 122000 | U1 | 11/2012 |
| RU | 124120 | U1 | 1/2013 |
| RU | 132318 | U1 | 9/2013 |
| RU | 2509516 | C2 | 3/2014 |
| RU | 2015105675 | A | 8/2015 |
| RU | 2013155697 | A | 10/2015 |
| RU | 2614615 | C2 | 3/2017 |
| RU | 2016150117 | A | 6/2018 |
| RU | 2687811 | C1 | 5/2019 |
| SE | 7415242 | A | 6/1975 |
| SE | 502503 | L | 10/2006 |
| TW | 274507 | | 4/1996 |
| TW | 201325481 | A | 7/2013 |
| WO | WO-8404698 | A1 | 12/1984 |
| WO | WO-8601730 | A1 | 3/1986 |
| WO | WO-8602528 | A1 | 5/1986 |
| WO | WO-9013326 | A1 | 11/1990 |
| WO | WO-9406314 | A1 | 3/1994 |
| WO | WO-9409842 | A1 | 5/1994 |
| WO | WO-9418860 | A1 | 9/1994 |
| WO | WO-9527411 | A1 | 10/1995 |
| WO | WO-9632854 | A2 | 10/1996 |
| WO | WO-9639880 | | 12/1996 |
| WO | WO-9748293 | A1 | 12/1997 |
| WO | WO-9805906 | A1 | 2/1998 |
| WO | WO-9817131 | A1 | 4/1998 |
| WO | WO-9823171 | A1 | 6/1998 |
| WO | WO-9835552 | A1 | 8/1998 |
| WO | WO-9914402 | A1 | 3/1999 |
| WO | WO-9947273 | A2 | 9/1999 |
| WO | WO-9947806 | A2 | 9/1999 |
| WO | WO-0009188 | A1 | 2/2000 |
| WO | WO-0021598 | A1 | 4/2000 |
| WO | WO-0028842 | A1 | 5/2000 |
| WO | WO-0028843 | A1 | 5/2000 |
| WO | WO-0050111 | A1 | 8/2000 |
| WO | WO-0104548 | A1 | 1/2001 |
| WO | WO-0140717 | A1 | 6/2001 |
| WO | WO-0163183 | A1 | 8/2001 |
| WO | WO-0167819 | A1 | 9/2001 |
| WO | WO-0205620 | A2 | 1/2002 |
| WO | WO-0205640 | A1 | 1/2002 |
| WO | WO-0206421 | A1 | 1/2002 |
| WO | WO-0207656 | A2 | 1/2002 |
| WO | WO-0224262 | A2 | 3/2002 |
| WO | WO-02051466 | A2 | 7/2002 |
| WO | WO-02051468 | A2 | 7/2002 |
| WO | WO-02058747 | A1 | 8/2002 |
| WO | WO-02096532 | A1 | 12/2002 |
| WO | WO-02098389 | A1 | 12/2002 |
| WO | WO-03012565 | A1 | 2/2003 |
| WO | WO-03028409 | A1 | 4/2003 |
| WO | WO-03037412 | A2 | 5/2003 |
| WO | WO-03049792 | A1 | 6/2003 |
| WO | WO-03050405 | A1 | 6/2003 |
| WO | WO-03059413 | A2 | 7/2003 |
| WO | WO-03070031 | A1 | 8/2003 |
| WO | WO-03083007 | A2 | 10/2003 |
| WO | WO-03083283 | A1 | 10/2003 |
| WO | WO-03101454 | A1 | 12/2003 |
| WO | WO-03103387 | A2 | 12/2003 |
| WO | WO-2004022128 | A2 | 3/2004 |
| WO | WO-2004022242 | A1 | 3/2004 |
| WO | WO-2004022243 | A1 | 3/2004 |
| WO | WO-2004089126 | A1 | 10/2004 |
| WO | WO-2004098324 | A2 | 11/2004 |
| WO | WO-2004104491 | A2 | 12/2004 |
| WO | WO-2004104492 | A2 | 12/2004 |
| WO | WO-2004104493 | A2 | 12/2004 |
| WO | WO-2005106350 | A2 | 11/2005 |
| WO | WO-2006022714 | A1 | 3/2006 |
| WO | WO-2006082571 | A1 | 8/2006 |
| WO | WO-2007012007 | A2 | 1/2007 |
| WO | WO-2007017482 | A1 | 2/2007 |
| WO | WO-2007040941 | A1 | 4/2007 |
| WO | WO 2007042941 | | 4/2007 |
| WO | WO-2007051163 | A2 | 5/2007 |
| WO | WO-2007054167 | A1 | 5/2007 |
| WO | WO-2007078273 | A1 | 7/2007 |
| WO | WO-2007090594 | A1 | 8/2007 |
| WO | WO-2007098337 | A2 | 8/2007 |
| WO | WO-2007116915 | A1 | 10/2007 |
| WO | WO-2007131449 | A1 | 11/2007 |
| WO | WO-2007131450 | A1 | 11/2007 |
| WO | WO-2007141668 | A2 | 12/2007 |
| WO | WO-2008015441 | A1 | 2/2008 |
| WO | WO-2008029381 | A2 | 3/2008 |
| WO | WO-2008038144 | A2 | 4/2008 |
| WO | WO-2008051909 | A1 | 5/2008 |
| WO | WO-2008069883 | A1 | 6/2008 |
| WO | WO-2008108889 | A1 | 9/2008 |
| WO | WO-2008121610 | A1 | 10/2008 |
| WO | WO-2008151777 | A2 | 12/2008 |
| WO | WO-2009001082 | A1 | 12/2008 |
| WO | WO-2009006521 | A2 | 1/2009 |
| WO | WO-2009015410 | A1 | 2/2009 |
| WO | WO-2009022232 | A2 | 2/2009 |
| WO | WO-2009042955 | A2 | 4/2009 |
| WO | WO-2009079641 | A2 | 6/2009 |
| WO | WO-2009092862 | A1 | 7/2009 |
| WO | WO-2009118085 | A1 | 10/2009 |
| WO | WO-2009132793 | A1 | 11/2009 |
| WO | WO-2009152651 | A1 | 12/2009 |
| WO | WO-2009155957 | A1 | 12/2009 |
| WO | WO-2009156181 | A2 | 12/2009 |
| WO | WO-2010017586 | A1 | 2/2010 |
| WO | WO-2010041354 | A1 | 4/2010 |
| WO | WO-2010045670 | A1 | 4/2010 |
| WO | WO-2010045671 | A1 | 4/2010 |
| WO | WO-2010047389 | A1 | 4/2010 |
| WO | WO-2010053467 | A1 | 5/2010 |
| WO | WO-2010060537 | A1 | 6/2010 |
| WO | WO-2010073018 | A1 | 7/2010 |
| WO | WO-2010102832 | A1 | 9/2010 |
| WO | WO-2010107613 | A1 | 9/2010 |
| WO | WO-2010118644 | A1 | 10/2010 |
| WO | WO-2010133342 | A1 | 11/2010 |
| WO | WO-2011045609 | A1 | 4/2011 |
| WO | WO-2011050943 | A1 | 5/2011 |
| WO | WO-2011050964 | A1 | 5/2011 |
| WO | WO-2011063970 | A1 | 6/2011 |
| WO | WO-2011068020 | A1 | 6/2011 |
| WO | WO-2011070785 | A1 | 6/2011 |
| WO | WO-2011079932 | A1 | 7/2011 |
| WO | WO-2011088132 | A1 | 7/2011 |
| WO | WO-2011101164 | A1 | 8/2011 |
| WO | WO-2011109304 | A2 | 9/2011 |
| WO | WO-2011109849 | A1 | 9/2011 |
| WO | WO-2011117580 | A2 | 9/2011 |
| WO | WO-2012014490 | A1 | 2/2012 |
| WO | WO-2012025496 | A1 | 3/2012 |
| WO | WO-2012054973 | A1 | 5/2012 |
| WO | WO-2012072770 | A1 | 6/2012 |
| WO | WO-2012072790 | A1 | 6/2012 |

(56) References Cited

FOREIGN PATENT DOCUMENTS

| | | | | |
|---|---|---|---|---|
| WO | WO-2012078865 | A2 | 6/2012 | |
| WO | WO-2012100430 | A1 | 8/2012 | |
| WO | WO-2013022936 | A1 | 2/2013 | |
| WO | WO-2013034453 | A1 | 3/2013 | |
| WO | WO-2013034454 | A1 | 3/2013 | |
| WO | WO-2013034455 | A1 | 3/2013 | |
| WO | WO-2013034458 | A1 | 3/2013 | |
| WO | WO-2013034459 | A1 | 3/2013 | |
| WO | WO-2013034460 | A1 | 3/2013 | |
| WO | WO-2013057185 | A1 | 4/2013 | |
| WO | WO-2013076098 | A2 | 5/2013 | |
| WO | WO-2013082173 | A1 | 6/2013 | |
| WO | WO-2013098395 | A1 | 7/2013 | |
| WO | WO-2013098405 | A2 | 7/2013 | |
| WO | WO-2013098409 | A1 | 7/2013 | |
| WO | WO-2013098410 | A2 | 7/2013 | |
| WO | WO-2013102609 | A2 | 7/2013 | |
| WO | WO-2013113612 | A1 | 8/2013 | |
| WO | WO-2013116558 | A1 | 8/2013 | |
| WO | WO-2013116572 | A1 | 8/2013 | |
| WO | WO-2013131764 | A1 | 9/2013 | |
| WO | WO-2013152873 | A1 | 10/2013 | |
| WO | WO-2013160112 | A2 | 10/2013 | |
| WO | WO-2013178767 | A1 | 12/2013 | |
| WO | WO-2014012906 | A1 | 1/2014 | |
| WO | WO-2014037794 | A2 | 3/2014 | |
| WO | WO-2014045025 | A2 | 3/2014 | |
| WO | WO-2014048475 | A1 | 4/2014 | |
| WO | WO-2014048745 | A1 | 4/2014 | |
| WO | WO-2014061477 | A1 | 4/2014 | |
| WO | WO-2014130695 | A1 | 8/2014 | |
| WO | WO-2014140320 | A1 | 9/2014 | |
| WO | WO-2014147114 | A1 | 9/2014 | |
| WO | WO-2014150131 | A1 | 9/2014 | |
| WO | WO-2014201432 | A1 | 12/2014 | |
| WO | WO-2015051646 | A1 | 4/2015 | |
| WO | WO-2015068936 | A1 | 5/2015 | |
| WO | WO-2015082648 | A1 | 6/2015 | |
| WO | WO-2015082649 | A1 | 6/2015 | |
| WO | WO-2015082651 | A1 | 6/2015 | |
| WO | WO-2015082652 | A1 | 6/2015 | |
| WO | WO-2015114328 | A1 | 8/2015 | |
| WO | WO-2015131058 | A1 | 9/2015 | |
| WO | WO-2015165812 | A1 | 11/2015 | |
| WO | WO-2015175568 | A1 | 11/2015 | |
| WO | WO-2015177043 | A1 | 11/2015 | |
| WO | WO-2015177044 | A1 | 11/2015 | |
| WO | WO-2015177045 | A1 | 11/2015 | |
| WO | WO-2015177254 | A1 | 11/2015 | |
| WO | WO-2015177255 | A1 | 11/2015 | |
| WO | WO-2015177256 | A1 | 11/2015 | |
| WO | WO-2015177257 | A1 | 11/2015 | |
| WO | WO-2015177263 | A1 | 11/2015 | |
| WO | WO-2015177264 | A1 | 11/2015 | |
| WO | WO-2015177265 | | 11/2015 | |
| WO | WO-2015177294 | A1 * | 11/2015 | ..... A24B 15/12 |
| WO | WO-2015198015 | A1 | 12/2015 | |
| WO | WO-2016014652 | A1 | 1/2016 | |
| WO | WO-2016075436 | A1 | 5/2016 | |
| WO | WO-2016156500 | A1 | 10/2016 | |
| WO | WO-2016184928 | A1 | 11/2016 | |
| WO | WO-2016184929 | A1 | 11/2016 | |
| WO | WO-2016184930 | A1 | 11/2016 | |
| WO | WO-2016200815 | | 12/2016 | |
| WO | WO-2017001819 | A1 | 1/2017 | |
| WO | WO-2017005705 | A1 | 1/2017 | |
| WO | WO-2017029268 | A1 | 2/2017 | |
| WO | WO-2017029269 | A1 | 2/2017 | |
| WO | WO-2017029270 | A1 | 2/2017 | |
| WO | WO-2017036950 | A2 | 3/2017 | |
| WO | WO-2017036955 | A2 | 3/2017 | |
| WO | WO-2017036959 | A1 | 3/2017 | |
| WO | WO-2017068094 | A1 | 4/2017 | |
| WO | WO-2017068098 | A1 | 4/2017 | |
| WO | WO-2017068099 | A1 | 4/2017 | |
| WO | WO-2017085242 | A1 | 5/2017 | |
| WO | WO-2017149093 | A1 | 9/2017 | |
| WO | WO-2017194769 | A1 | 11/2017 | |
| WO | WO-2017205692 | A1 | 11/2017 | |
| WO | WO-2017207581 | A1 | 12/2017 | |
| WO | WO-2018002083 | A1 | 1/2018 | |
| WO | WO-2018073376 | A1 | 4/2018 | |
| WO | WO-2018178095 | A1 | 10/2018 | |
| WO | WO-2020047417 | A1 | 3/2020 | |

OTHER PUBLICATIONS

English Translation of Chinese First Office Action, Application No. 2016800498584, dated Nov. 1, 2019, 6 pages.

Qiu Gaohe, Chinese Scientific Information, vol. 10, pp. 132-133, issued May 15, 2010.

Application and File History for U.S. Appl. No. 14/428,626, filed Mar. 16, 2015, Inventors Hatrick et al.

Application and File History for U.S. Appl. No. 14/840,652, filed Aug. 31, 2015, inventors Blandino et al.

Application and File History for U.S. Appl. No. 14/840,703, filed Aug. 31, 2015, inventors Wilke et al.

Application and File History for U.S. Appl. No. 14/840,731, filed Aug. 31, 2015, inventors Blandino et al.

Application and File History for U.S. Appl. No. 14/840,972, filed Aug. 31, 2015, inventors Wilke et al.

Application and File History for U.S. Appl. No. 14/927,532, filed Oct. 30, 2015, inventors Blandino et al.

Application and File History for U.S. Appl. No. 15/754,801, filed Feb. 23, 2018, Inventors Blandino et al.

Application and File History for U.S. Appl. No. 15/754,809, filed Feb. 23, 2018, Inventors Wilke et al.

Application and File History for U.S. Appl. No. 15/754,837, filed Feb. 23, 2018, Inventors Wilke et al.

Application and File History for U.S. Appl. No. 15/772,386, filed Apr. 30, 2018, Inventors Blandino et al.

Chaplin M., "Hydrocolloids and Gums," retrieved from http://www1.lsbu.ac.uk/water/hydrocolloids_gums.html, Established in 2001, 7 pages.

CN203762288U, "Atomization Device Applicable to Solid Tobacco Materials and Electronic Cigarette," retrieved from Google Patents https://patents.google.com/patent/CN203762288U/en on Jan. 12, 2018, 10 pages.

English translation of CN101390659 dated Aug. 3, 2017, 8 pages.

First Office Action dated Dec. 3, 2015 for Chinese Application No. 201380021387.2, filed Apr. 11, 2011, 20 pages.

First Office Action dated May 5, 2016 for Chinese Application No. 201380048636.7, 25 pages.

Ineos., "Typical Engineering Properties of High Density Polyethylene," Olefins and Polymers, USA, retrieved from https://www.ineos.com/globalassets/ineos-group/businesses/ineos-olefins-and-polymers-USA/products/technical-information--patents/ineos-typical-engineering-properties-of-hdpe.pdf, Accessed Dec. 4, 2018, 2 pages.

International Preliminary Report on Patentability for Application No. PCT/EP2013/068797, dated Mar. 31, 2015, 5 pages.

International Preliminary Report on Patentability for Application No. PCT/EP2016/070176, dated Mar. 15, 2018, 12 pages.

International Preliminary Report on Patentability for Application No. PCT/EP2016/070178, dated Mar. 15, 2018, 8 pages.

International Preliminary Report on Patentability for Application No. PCT/EP2016/070182, dated Mar. 15, 2018, 8 pages.

International Preliminary Report on Patentability for Application No. PCT/EP2016/070185, dated Mar. 15, 2018, 11 pages.

International Preliminary Report on Patentability for Application No. PCT/EP2016/070188, dated Mar. 15, 2018, 8 pages.

International Preliminary Report on Patentability for Application No. PCT/EP2016/070191, dated Mar. 15, 2018, 8 pages.

International Preliminary Report on Patentability for Application No. PCT/EP2016/075734, dated May 11, 2018, 7 pages.

International Preliminary Report on Patentability for Application No. PCT/EP2016/075739, dated Jan. 16, 2018, 7 pages.

International Preliminary Report on Patentability for Application No. PCT/GB2013/052433, dated Mar. 24, 2015, 9 pages.

(56) References Cited

OTHER PUBLICATIONS

International Search Report and Written Opinion for Application No. PCT/EP2013/068797, dated Dec. 9, 2013, 8 pages.
International Search Report and Written Opinion for Application No. PCT/EP2016/070176, dated Apr. 19, 2017, 21 pages.
International Search Report and Written Opinion for Application No. PCT/EP2016/070178, dated Dec. 14, 2016, 10 pages.
International Search Report and Written Opinion for Application No. PCT/EP2016/070182, dated Dec. 12, 2016, 11 pages.
International Search Report and Written Opinion for Application No. PCT/EP2016/070185, dated Apr. 4, 2017, 16 pages.
International Search Report and Written Opinion for Application No. PCT/EP2016/070188, dated Dec. 13, 2016, 10 pages.
International Search Report and Written Opinion for Application No. PCT/EP2016/070191, dated Dec. 13, 2016, 10 pages.
International Search Report and Written Opinion for Application No. PCT/EP2016/075734, dated Apr. 6, 2017, 12 pages.
International Search Report and Written Opinion for Application No. PCT/EP2016/075739, dated Feb. 24, 2017, 10 pages.
International Search Report and Written Opinion for Application No. PCT/GB2013/052433, dated Jun. 30, 2014, 16 pages.
Iorga A., et al., "Low Curie Temperature in Fe—Cr—Ni—Mn Alloys," U.P.B. Sci.Bull., Series B, vol. 73 (4), 2011, pp. 195-202.
jrank.org, "Heat Capacity—Heat Capacity and Calorimetry, Heat Capacity and the Law of Conservation of Energy—Significance of the High Heat Capacity of Water," retrieved from https://science.jrank.org/pages/3265/Heat-Capacity.html, Accessed Jun. 15, 2017, 2 pages.
Neomax Materials Co., Ltd., "NeoMax MS-135," retrieved from http://www.neomax-materials.co.jp/eng/pr0510.htm, as accessed on Oct. 30, 2015, 2 pages.
Notification of Reasons for Refusal dated Feb. 1, 2016 for Japanese Application No. 2015531544, 5 pages.
Office Action dated Feb. 13, 2019 for Japanese Application No. 2018-507624, 32 pages.
Office Action dated Feb. 14, 2019 for Canadian Application No. 2996835, 3 pages.
Office Action dated Feb. 19, 2019 for Canadian Application No. 2995315, 4 pages.
Office Action dated Feb. 8, 2019 for Korean Application No. 10-2018-7006077, 8 pages (15 pages with translation).
Office Action madated iled Jan. 8, 2019 for Japanese Application No. 2017-075527, 15 pages.
Office Action dated Jan. 31, 2019 for Korean Application No. 10-2018-7006009, 17 pages.
Office Action dated Mar. 13, 2018 for Japanese Application No. 2017-075527, 10 pages.
Office Action dated Mar. 26, 2019 for Japanese Application No. 2018-506381, 11 pages.
Office Action dated Sep. 13, 2017 for Russian Application No. 2015106592/12, 6 pages.
Rasidek N.A.M., et al., "Effect of Temperature on Rheology Behaviour of Banana Peel Pectin Extracted Using Hot Compressed Water," Jurnal Teknologi (Sciences & Engineering), vol. 80 (3), Apr. 1, 2018, pp. 97-103.
Second Office Action dated Jan. 16, 2017 for Chinese Application No. 201380048636.7, 24 pages.
The Engineering Toolbox., "Specific Heats for Metals," retrieved from https://www.engineeringtoolbox.com/specific-heat-metals-d_152.html, 2003, 6 pages.
Todaka T., et al., "Low Curie Temperature Material for Induction Heating Self-Temperature Controlling System," Journal of Magnetism and Magnetic Materials, vol. 320 (20), Oct. 2008, pp. e702-e707.
UKIPO Search Report for UK Application No. GB1216621.1, dated Jan. 17, 2013, 6 pages.
University of Illinois, "Scientific Principles," retrieved from http://matse1.matse.illinois.edu/ceramics/prin.html, Accessed Jun. 15, 2017, 13 pages.
Japanese Office Action, Application No. 2018-506575, dated Nov. 12, 2019, 8 pages.
English Translation of Japanese Office Action, Application No. 2018-521547, 4 pages, dated Jun. 25, 2019.
Japanese Office Action, Application No. 2018-507624, dated Oct. 29, 2019, 14 pages.
Japanese Office Action, Application No. 2018-506565, dated Nov. 5, 2019, 7 pages.
English Translation of Japanese Office Action, Application No. 2018-506565, dated Mar. 19, 2019.
Chinese Office Action, Application No. 201680049679.0, dated Nov. 4, 2019, 12 pages.
English Translation of Korean Office Action, Application No. 10-2018-7006070, dated Feb. 7, 2019.
Application and File History for U.S. Appl. No. 15/754,812, filed Feb. 23, 2018, Inventors Blandino et al.
Taiwan Office Action, Application No. 105127626, dated Feb. 27, 2020, 12 pages.
Korean Office Action, Application No. 10-2018-7006009, dated Aug. 29, 2019, 9 pages.
Chinese Office Action, Application No. 201680049815.6, dated Oct. 21, 2019, 20 pages.
Japanese Office Action, Application No. 2018-506553, dated Mar. 19, 2019, 8 pages.
Japanese Office Action, Application No. 2018-506553, dated Nov. 5, 2019, 12 pages.
English Translation of Chinese Office Action, Application No. 201680049815.6, dated May 6, 2020, 7 pages.
CN203762288, Machine Translation, retrieved Online from Espacenet on Aug. 13, 2020, (http://worldwide.espacenet.com), 5 pages.
European Extended Search Report for Application No. 19216472.1 dated Apr. 22, 2020, 13 Pages.
European Notice of Opposition for Application No. 13759537 dated Jan. 23, 2020, 83 pages.
Extended European Search Report for Application No. 19164405.3 dated Aug. 28, 2019, 6 pages.
Extended European Search Report for Application No. 19165045.6 dated Sep. 6, 2019, 7 Pages.
Office Action dated Oct. 18, 2019 for Chinese Application No. 201680049874.3, 18 pages.
Office Action for Chinese Application No. 20168004985 dated Jul. 3, 2020, 35 pages.
Office Action for Chinese Application No. 20168049858 dated Jul. 3, 2020, 35 pages.
Office Action dated Sep. 1, 2020 for Japanese Application No. 2018-506381, 25 pages.
Office Action dated Sep. 12, 2019 for Chilean Application No. 201800521, 8 pages.
Office Action dated Dec. 19, 2019 for Taiwan Application No. 105127627, 14 pages.
Office Action dated Mar. 19, 2019 for Japanese Application No. 2018-506575, 10 pages.
Office Action dated Jun. 25, 2019 for Japanese Application No. 2018-519865, 3 pages.
Office Action dated Apr. 27, 2020 for the Brazilian Application No. 112017028539.8, 5 pages.
Office Action dated Mar. 28, 2019 for Canadian Application No. 3003514, 6 pages.
Office Action dated Dec. 3, 2019 for Japanese Application No. 2018-521547, 4 pages.
Office Action dated Dec. 3, 2019 for Japanese Application No. 2018-506381, 8 pages.
Office Action dated May 7, 2019 for Japanese Application No. 2018-506563, 4 pages.
Office Action dated Jun. 9, 2020 for Chinese Application No. 201680061969.7, 15 pages.
"Polyetheretherketone—Online Catalog Source," Retrieved from http://www.goodfellow.com/A/Polyethertherketone.html, Jan. 17, 2020. 4 pages.
Shuisheng X., et al., "Semisolid processing technology," 2012, 10 pages ISBN 978-7-5024-5935-2.
Jinshu Bangutai Jiagong Jishu, Metallurgical Industry Press, 10 pages, dated Jun. 30, 2012.

(56) References Cited

OTHER PUBLICATIONS

European Extended Search Report, Application No. 20179569.7, dated Oct. 2, 2020, 10 pages.
European Search Report for European Application No. 20205544.8, dated Jun. 14, 2021, 9 pages.
Application and File History for U.S. Appl. No. 15/754,818, filed Feb. 23, 2018, Inventors Blandino et al.
Extended European Search Report for Application No. EP20205075.3, dated Jan. 27, 2021, 11 pages.
International Search Report and Written Opinion for Application No. PCT/EP2016//085686, dated May 9, 2019, 16 pages.
Office Action dated Feb. 15, 2021 for Ukraine Application No. 201801751, 4 pages.
Office Action dated Feb. 16, 2021 for Ukraine Application No. 201801846, 3 pages.
Office Action dated Jan. 28, 2021 for Chinese Application No. 201680049874.3, 6 pages.
Office Action dated Aug. 5, 2020 for Chinese Application No. 201680049874.3, 6 pages.
Office Action for Chinese Application No. 201680049479.5, dated Feb. 4, 2021, 8 pages.
Office Action for Malaysian Application No. PI2018700428, dated Mar. 1, 2021, 3 pages.
Office Action dated Sep. 15, 2020 for Japanese Application No. 2019-118784, 14 pages.
Office Action dated Sep. 17, 2020 for Canadian Application No. 2996342, 4 pages.
Office Action dated Jun. 19, 2020 for Canadian Application No. 2995315, 4 pages.
Office Action dated Sep. 29, 2020 for Japanese Application No. 2018-506563, 5 pages.
Office action dated Sep. 8, 2020 for Japanese Application No. 2018-507624, 7 pages.
Application and File History for U.S. Appl. No. 14/840,751, filed Aug. 31, 2015, inventors Blandino et al.
Application and File History for U.S. Appl. No. 14/840,854, filed Aug. 31, 2015, inventors Blandino et al.
Application and File History for U.S. Appl. No. 14/927,529, filed Oct. 30, 2015, inventors Kaufman et al.
Application and File History for U.S. Appl. No. 14/927,537, filed Oct. 30, 2015, inventors Kaufman et al.
Application and File History for U.S. Appl. No. 14/927,539, filed Oct. 30, 2015, inventors Blandino et al.
Application and File History for U.S. Appl. No. 14/927,551, filed Oct. 30, 2015, inventors Blandino et al.
Application and File History for U.S. Appl. No. 14/927,556, filed Oct. 30, 2015, inventors Blandino et al.
Application and File History for U.S. Appl. No. 15/772,382, filed Apr. 30, 2018, Inventors Kaufman Wilke et al.
CN-203952405-U, "Tobacco Suction System Based on Electromagnetic Heating—Google Patents," (Machine Translation) [online], Retrieved on Nov. 29, 2021, Retrieved from Google Patents (https://patents.google.com/), 2014, 4 pages.
Extended European Search Report for Application No. 20205043.1, dated May 4, 2021, 10 pages.
Extended European Search Report for Application No. 20205057.1, dated Oct. 19, 2021, 20 pages.
Notice of Reasons for Rejection for Japanese Application No. 2020-182759, dated Oct. 12, 2021, 5 pages.
Notification of Reasons for Refusal dated May 18, 2021 for Japanese Application No. 2020126181, 8 pages.
Office Action for Chinese Application No. 201680049858.4, dated Jul. 1, 2021, 13 pages.
Office Action for Japanese Application No. 2018-506381, dated Apr. 13, 2021, 5 pages.
Office Action for Japanese Application No. 2020-067569, dated Nov. 9, 2021, 6 pages.
Office Action for Japanese Application No. 2020-126181, dated Nov. 30, 2021, 4 pages.
Office Action for Japanese Application No. 2020-183056, dated Nov. 9, 2021, 14 pages.
Office Action for Russian Application No. 2020121132, dated Aug. 6, 2021, 11 pages.
Office Action for Russian Application No. 2020135756, dated Jun. 30, 2021, 9 pages.
Office Action dated Jun. 8, 2021 for Japanese Application No. 2020-526233, 22 pages.
Office Action dated Sep. 17, 2020 for Canadian Application No. 2995315, 4 pages.
Partial European Search Report for Application No. 20205057.1, dated Apr. 29, 2021, 16 pages.
Fourth Office Action and Search Report for Chinese Application No. 2016800498584 dated Jan. 6, 2022, 21 pages.
Notice of Reasons for Rejection for Japanese Application No. 2020-182762, dated Dec. 7, 2021, 9 pages.
Communication pursuant to Article 94(3) EPC for Application No. 16766233.7 dated Mar. 7, 2022, 16 pages.
Communication Pursuant to Article 94(3) EPC for Application No. 16766234.5 dated Mar. 7, 2022, 4 pages.
Decision of Rejection dated Apr. 15, 2022 for Chinese Application No. 20168009479.5, 7 pages.
Decision to Grant a Patent dated Apr. 5, 2022 for Japanese Application No. 2020-182759, 5 pages.
Extended European Search Report for Application No. 21170804.5, dated Feb. 21, 2022, 13 pages.
Extended European Search Report for Application No. 21192233.1, dated Dec. 9, 2021, 11 pages.
Fourth Office Action and Search Report for Chinese Application No. 201680049479.5 dated Nov. 18, 2021, 20 pages.
Notice of Reasons for Refusal dated Nov. 2, 2021 for Japanese Application No. 2020-182712, 6 pages.
Notice of Reasons for Refusal dated Jan. 25, 2022 for Japanese Application No. 2020-183045, 9 pages.
Notice of Reasons for Rejection for Japanese Application No. 2020-181533, dated Apr. 26, 2022, 3 pages.
Notice of Reasons for Rejection dated Jan. 19, 2022 for Japanese Application No. 2020-183046, 6 pages.
Notice of Reasons for Rejection dated Apr. 26, 2022 for Japanese Application No. 2022-013252, 4 pages.
Office Action for Brazilian Application No. 112018004103-3, dated Feb. 1, 2022, 4 pages.
Office Action for Brazilian Application No. 112018004110-6, dated Jan. 31, 2022, 4 pages.
Office Action for Chinese Application No. 201680049858.4, dated Apr. 1, 2022, 15 pages.
Office Action for Russian Application No. 2018115288, dated Oct. 17, 2018, 7 pages.
Office Action dated Feb. 16, 2022 for Japanese Application No. 2019-118784, 28 pages.
Partial European Search Report for Application No. 21170791.4, dated Nov. 22, 2021, 16 pages.
Physics., "Analysis Series of Typical Examples of College Entrance Examination," Editorial Board, Heilongjiang Science and Technology Press, Dec. 31, 1995, 47 pages.
Search Report for Japanese Application No. 2020-521547, dated Jun. 14, 2019, 22 pages.
Written Opinion of the International Preliminary Examining Authority for Application No. PCT/EP2016/075739, dated Sep. 28, 2017, 6 pages.
Application and File History for U.S. Appl. No. 15/991,512, filed May 29, 2018, inventors Abramov et al.
Application and File History for U.S. Appl. No. 15/470,078, filed Mar. 27, 2017, inventor Buchberger.
Application and File History for U.S. Appl. No. 15/470,089, filed Mar. 27, 2017, inventor Buchberger.
Application and File History for U.S. Appl. No. 15/470,095, filed Mar. 27, 2017, inventor Buchberger.
Application and File History for U.S. Appl. No. 14/899,629, filed Dec. 18, 2015, inventors Brereton et al.
Application and File History for U.S. Appl. No. 14/902,663, filed Jan. 4, 2016, inventors Harding et al.

(56) References Cited

OTHER PUBLICATIONS

Application and File History for U.S. Appl. No. 14/962,817, filed Dec. 8, 2015, inventors Egoyants et al.
Application and File History for U.S. Appl. No. 15/437,522, filed Feb. 21, 2017, inventors Abramov et al.
Application and File History for U.S. Appl. No. 13/583,381, filed Dec. 17, 2012, inventor Buchberger.
Application and File History for U.S. Appl. No. 14/127,133, filed Jul. 15, 2014, inventors Vasiliev et al.
Application and File History for U.S. Appl. No. 14/127,138, filed Feb. 10, 2014, inventors Egoyants et al.
Application and File History for U.S. Appl. No. 14/127,144, filed Mar. 31, 2014, inventors Egoyants et al.
Application and File History for U.S. Appl. No. 14/127,148, filed Mar. 12, 2014, inventors Egoyants et al.
Application and File History for U.S. Appl. No. 14/127,879, filed May 9, 2014, inventors Egoyants et al.
Application and File History for U.S. Appl. No. 14/343,368, filed Jun. 24, 2014, inventors Abramov et al.
Application and File History for U.S. Appl. No. 14/382,198, filed Aug. 29, 2014, inventors Saleem et al.
Application and File History for U.S. Appl. No. 15/379,946, filed Dec. 15, 2016, inventors Egoyants et al.
Application and File History for U.S. Appl. No. 15/437,517, filed Feb. 21, 2017, inventors Abramov et al.
Brief Communication for European Application No. 12750765.5, dated Aug. 31, 2021, 16 pages.
Chemical Engineering, "A Vacuum Insulation that is Ultrathin", Aug. 1, 2011, 5 pages.
Collier J.G. et al., "10.3 Mechanism of Evaporation and Condensation," Convective Boiling and Condensation, Third Edition, Clarendon Press, 1994, 6 pages.
Communication of a Notice of Opposition, dated Nov. 25, 2020, for European Patent Application No. 13716763.1, 26 pages.
Communication pursuant to Article 94(3) EPC for Application No. 22155465.2, dated Aug. 5, 2022, 7 pages.
Company Filtrona Richmond Inc., www.filtronaporoustechnologies.com, Nov. 19, 2018, 1 page.
Concept Group, "New Super Insulator form Concept Group Stops Heat Conduction in Tight Spaces," https://www.businesswire.com/news/home/20110610006023/en/New-Super-Insulator-Concept-Group-Stops-Heat, 2011, 5 pages.
Concept Group "Concept Group's New Thermal Insulator Thinner Than Human Hair", Jun. 29, 2011, 2 pages.
Concept Group, "Insulon® Thermal Barrier from Concept Group Blocks Heat with Hyper-Deep Vacuum™," Dec. 15, 2011, 1 page.
Davies, et al., "Metallic Foams: Their Production, Properties and Applications," Journal of Materials Science, 1983, vol. 18(7), pp. 1899-1911.
Decision to Grant a Patent dated Nov. 15, 2016 for Japanese Application No. 2015-506185 filed Apr. 11, 2013, 5 pages.
Decision to Grant a Patent dated May 22, 2018 for Japanese Application No. 2016-134648, 5 pages.
Decision to Grant dated Apr. 1, 2014 for Russian Application No. 2011120430, 16 pages.
Decision to Grant dated Aug. 5, 2014 for Japanese Application No. 2011-532464, 6 pages.
Diener Electronic, "Plasma Polymerization," The company Diener electronic GmbH+Co. KG, Retrieved on Oct. 17, 2017, 19 pages.
Dunn P.D., et al., "Heat Pipes," Fourth Edition, Pergamon, ISBN0080419038, 1994, 14 pages.
English Translation for Vietnam Opposition for Application No. PCT/EP2013/057539, dated Jun. 29, 2018, 29 pages.
European Extended Search Report for European Application No. 201576220, dated May 28, 2020, 12 pages.
European Search Report for European Application No. 22155465.2, dated Jul. 25, 2022, 4 pages.
Examination Report for Canadian Application No. 2,845,754, dated Aug. 19, 2021, 6 pages.
Examination Report for Canadian Application No. 2,845,754, dated Nov. 4, 2020, 5 pages.
Examination Report for Indian Application No. 201947043640, dated Aug. 11, 2020, 7 pages.
Examination Report for Indonesian Application No. P00201908524, dated Dec. 24, 2021, 5 pages.
Examination Report for Indonesian Application No. P00201908525, dated Dec. 24, 2021, 5 pages.
Examination Report for New Zealand Application No. 718007 dated Aug. 1, 2016, 4 pages.
Examination Report dated Jan. 9, 2019 for Philippines Application No. 1/2016/500805, 6 pages.
Examination Report dated Feb. 21, 2018 for Australian Application No. 2016204192, 7 pages.
Examination Report No. 1 for Australian Application No. 2020294182, dated Mar. 5, 2022, 3 pages.
Examination Report No. 1 for Australian Patent Application No. 2020235037, dated May 26, 2022, 3 pages.
Extended European Search Report for U.S. Appl. No. 15/178,588, dated Apr. 14, 2016, 2 pages.
Extended European Search Report for Application No. 15200661.5, dated May 18, 2016, 6 pages.
Extended European Search Report for U.S. Appl. No. 16/166,656, dated Oct. 11, 2016, 9 pages.
Extended European Search Report for Application No. 17189951.1, dated Jan. 4, 2018, 11 pages.
Extended European Search Report for Application No. 18157257.9, dated Jun. 28, 2018, 7 pages.
Extended European Search Report for Application No. 18205608.5, dated Jul. 12, 2019, 7 pages.
Extended European search report for Application No. 20157622.0, dated May 28, 2020, 12 pages.
Extended European Search Report for Application No. 20205071.2, dated Jul. 16, 2021, 8 pages.
Extended European Search Report for Application No. 21170791.4, dated Jun. 28, 2022, 15 pages.
Extended European Search Report for Application No. 21171022.3, dated Dec. 3, 2021, 8 pages.
Extended European Search Report for European Application No. 20206770.8, dated Mar. 3, 2021, 10 pages.
First Office Action dated Jun. 15, 2015 and Search Report dated Jun. 2, 2015 for Chinese Application No. 201280029784.X, filed Aug. 24, 2012, 27 pages.
First Office Action dated Dec. 3, 2012 for Chinese Application No. 200980152395.4, 16 pages.
Hegbom T., "Integrating Electrical Heating Elements in Appliance Design," cited in EP2871983, resulting in interlocutory decision dated Aug. 7, 2019, 4 pages.
International Preliminary Report on Patentability for Application No. PCT/AT2012/000017, dated Aug. 13, 2013, 5 pages.
International Preliminary Report on Patentability for Application No. PCT/EP2012/066484, dated Mar. 20, 2014, 7 pages.
International Preliminary Report on Patentability for Application No. PCT/EP2012/066485, dated Dec. 20, 2013, 12 pages.
International Preliminary Report on Patentability for Application No. PCT/EP2012/070647, dated Apr. 22, 2014, 8 pages.
International Preliminary Report on Patentability for Application No. PCT/EP2014/063785, dated Jun. 1, 2015, 12 pages.
International Preliminary Report on Patentability for Application No. PCT/EP2014/072828, dated May 12, 2016, 7 pages.
International Preliminary Report on Patentability for Application No. PCT/EP2015/064595, dated Oct. 25, 2016, 20 pages.
International Preliminary Report on Patentability for Application No. PCT/GB2014/051332, dated Nov. 12, 2015, 7 pages.
International Preliminary Report on Patentability for Application No. PCT/GB2014/051333, dated Aug. 5, 2015, 12 pages.
International Preliminary Report on Patentability for Application No. PCT/GB2014/051334, dated Nov. 12, 2015, 7 pages.
International Preliminary Report on Patentability for Application No. PCT/GB2015/051213, dated Jul. 14, 2016, 20 pages.
International Preliminary Report on Patentability for Application No. PCT/GB2017/051139, dated Aug. 6, 2018, 7 pages.

(56) References Cited

OTHER PUBLICATIONS

International Preliminary Report on Patentability for Application No. PCT/US2012/066523, dated Jun. 4, 2015, 6 pages.
International Preliminary Report on Patentability for Application No. PCT/EP2018/057835 dated Oct. 10, 2019, 15 pages.
International Preliminary Report on Patentability for Application No. PCT/EP2012/066486, dated Oct. 22, 2013, 10 pages.
International Preliminary Report on Patentability for Application No. PCT/EP2012/066523, dated Nov. 4, 2013, 9 pages.
International Preliminary Report on Patentability for Application No. PCT/EP2012/066524, dated Oct. 17, 2013, 11 pages.
International Preliminary Report on Patentability for Application No. PCT/EP2018/057834, dated Oct. 10, 2019, 13 pages.
International Search Report and Written Opinion for Application No. PCT/AT2012/000017, dated Jul. 3, 2012, 6 pages.
International Search Report and Written Opinion for Application No. PCT/EP2012/003103, dated Nov. 26, 2012, 6 pages.
International Search Report and Written Opinion for Application No. PCT/EP2012/070647, dated Feb. 6, 2013, 9 pages.
International Search Report and Written Opinion for Application No. PCT/EP2013/057539, dated Feb. 11, 2014, 16 pages.
International Search Report and Written Opinion for Application No. PCT/EP2014/063785, dated Oct. 30, 2014, 10 pages.
International Search Report and Written Opinion for Application No. PCT/EP2014/064365, dated Oct. 7, 2014, 11 pages.
International Search Report and Written Opinion for Application No. PCT/EP2014/072828, dated Jun. 16, 2015, 10 pages.
International Search Report and Written Opinion for Application No. PCT/EP2018/057835, dated Nov. 6, 2018, 26 pages.
International Search Report and Written Opinion for Application No. PCT/GB2014/051332, dated Jul. 21, 2014, 8 pages.
International Search Report and Written Opinion for Application No. PCT/GB2014/051333, dated Jul. 17, 2014, 10 pages.
International Search Report and Written Opinion for Application No. PCT/GB2014/051334, dated Jul. 21, 2014, 8 pages.
International Search Report and Written Opinion for Application No. PCT/GB2017/051139, dated Aug. 9, 2017, 14 pages.
International Search Report and Written Opinion for Application No. PCT/US2012/066523, dated May 29, 2013, 7 pages.
International Search Report and Written Opinion for Application No. PCT/EP2018/057834, dated Nov. 6, 2018, 20 pages.
International Search Report and Written Opinion for International Application No. PCT/EP2020/056231 dated Jul. 15, 2020, 11 pages.
International Search Report and Written Opinion for Application No. PCT/EP2012/066484, dated Jan. 9, 2013, 9 pages.
International Search Report and Written Opinion for Application No. PCT/EP2012/066486, dated Jan. 14, 2013, 8 pages.
International Search Report and Written Opinion for Application No. PCT/EP2012/066523, dated Jan. 9, 2013, 9 pages.
International Search Report and Written Opinion for Application No. PCT/EP2012/066524, dated Jan. 9, 2013, 8 pages.
International Search Report and Written Opinion for Application No. PCT/EP2012/066525, dated Jan. 9, 2013, 10 pages.
International Search Report and Written Opinion for Application No. PCT/EP2012/066485, dated Dec. 10, 2012, 10 pages.
International Search Report and Written Opinion for Application No. PCT/AT2011/000123, dated Jul. 18, 2011, 8 pages.
International Search Report for Application No. PCT/AT2009/000413, dated Jan. 25, 2010, 3 pages.
International Search Report for Application No. PCT/AT2009/000414, dated Jan. 26, 2010, 2 pages.
International Search Report for Application No. PCT/EP2015/064595, dated Jan. 5, 2016, 6 pages.
International Search Report for Application No. PCT/GB2015/051213, dated Jul. 16, 2015, 5 pages.
International Search Report for Application No. PCT/US2019/049076, dated Dec. 18, 2019, 4 pages.
Invitation to Pay Additional Fees for Application No. PCT/EP2018/057835, dated Jul. 17, 2018, 20 pages.
Invitation to Pay Additional Fees with Partial International Search for Application No. PCT/EP2018/057834 dated Jul. 13, 2018, 18 pages.
Korean Office Action, Application No. 1020197037986, dated Feb. 6, 2020, 11 pages.
Kynol, "Standard Specifications of Kynol™ Activated Carbon Fiber Products," Sep. 19, 2013, 2 pages.
Merriam-Webster, "Definition of Film", Retrieved from the Internet: https://www.merriam-webster.com/dictionary/Film on Sep. 17, 2019, 13 pages.
Minco Products Inc., "Thermofoil™ Heaters," Bulletin HS-202(D), Jul. 22, 2004, 60 pages.
National Plastic Heater, Sensor and Control Inc., "Kapton (Polyimide) Flexible Heaters," 2011, retrieved from https://www.kapton-silicone-flexible-heaters.com/products/kapton_polyimide_flexible_heaters.html on Feb. 23, 2018, 2 pages.
International Preliminary Report on Patentability for Application No. PCT/EP2012/066525, dated Mar. 20, 2014, 8 pages.
Notice of Opposition dated Mar. 7, 2017 for European Application No. 12750770.5, 22 pages.
Notice of Opposition Letter from EPO Opposition against the European Application No. 2358418, mailed Mar. 1, 2017, 60 pages.
Notice of Opposition mailed Sep. 20, 2021 for European Application No. 18157257.9 (EP3354144), 31 pages.
Notice of Reasons for Rejection for Japanese Application No. 2020-181532, dated Jun. 21, 2022, 6 pages.
Notice of Reasons for Rejection dated May 23, 2017 for Japanese Application No. 2016134648, 18 pages.
Notice of Reasons for Rejection dated May 31, 2016 for Japanese Application No. 2015-137361, 6 pages.
Notice of Reasons for Rejection dated Oct. 7, 2013 for Japanese Application No. 2011532464, 6 pages.
Notice of Reasons for Rejection dated Sep. 8, 2015 for Japanese Application No. 2014179732, 5 pages.
Notification to Grant Patent Right for Invention dated Oct. 25, 2018 for Chinese Application No. 201610086101.4, 2 pages.
Office Action dated Jan. 23, 2019 for Korean Application No. 20187017575, 9 pages.
Office Action dated Jul. 8, 2016 for Chinese Application No. 201380021387.2, filed Apr. 11, 2011, 12 pages.
Office Action dated Sep. 25, 2018 for European Application No. 12750765.5 filed Aug. 24, 2012, 22 pages.
Office Action dated Sep. 26, 2018 for European Application No. 12750765.5 filed Aug. 24, 2012, 67 pages.
Office Action dated Sep. 29, 2015 for Japanese Application No. 2015-506185 filed Apr. 11, 2013, 5 pages.
Office Action dated Mar. 31, 2015 for Japanese Application No. 2014-519585 filed Aug. 24, 2012, 8 pages.
Office Action dated Apr. 7, 2015 for Japanese Application No. 2014-519586 filed Aug. 24, 2012, 10 pages.
Office Action and Search Report dated Apr. 27, 2015 for Chinese Application No. 201280030681.5, filed Aug. 24, 2012, 25 pages.
Office Action and Search Report dated Feb. 28, 2019 for Japanese Application No. 2018-088088, 25 pages.
Office Action dated Jun. 16, 2020 for Japanese Application No. 2019-065344, 10 pages.
Office Action for Canadian Application No. 3,057,903, dated Dec. 15, 2020, 6 pages.
Office Action for Canadian Application No. 3,057,903, dated Aug. 30, 2021, 4 pages.
Office Action for Canadian Application No. 3,057,905, dated Jan. 20, 2021, 6 pages.
Office Action for Chinese Application No. 2018800231958, dated Apr. 21, 2021, 17 pages.
Office Action for Chinese Application No. 2018800231958, dated Dec. 17, 2021, 10 pages.
Office Action for Chinese Application No. 201880023195.8, dated Jun. 21, 2022, 4 pages.
Office Action for Japanese Application No. 2019-551462 dated Dec. 15, 2020, 4 pages.
Office Action for Japanese application No. 2019-551471, dated Apr. 20, 2021, 2 pages.

(56) References Cited

OTHER PUBLICATIONS

Office Action for Japanese Application No. 2019-551471 dated Dec. 15, 2020, 8 pages.
Office Action for Japanese Application No. 2020-121066, dated Jun. 22, 2021, 6 pages.
Office action for Japanese Application No. 2021-074263, dated Jun. 14, 2022, 14 pages.
Office action for Japanese Application No. 2021-074266, dated Jul. 26, 2022, 8 pages.
Office Action for Korean Application No. 10-2019-7032076, dated May 25, 2021, 4 pages.
Office action for Korean Application No. 10-2019-7038229, dated Jul. 19, 2022, 15 pages.
Office Action for Korean Application No. 10-2020-7017740, dated Feb. 8, 2022, 14 pages.
Office Action for Korean Application No. 10-2020-7017746, dated Feb. 10, 2022, 25 pages.
Office Action for Korean Application No. 10-2020-7031372, dated Dec. 9, 2020, 13 pages.
Office Action for Korean Application No. 10-2021-7013743, dated Nov. 22, 2021, 17 pages.
Office Action for Russian Application No. 2021112978, dated Oct. 28, 2021, 8 pages.
Office Action for Russian Application No. 2020 135 861, dated Apr. 13, 2021, 2 pages.
Office Action dated Jul. 4, 2018 for Russian Application No. 2018101312, 11 pages.
Office Action dated Apr. 5, 2019 for Korean Application No. 10-2018-7019884, 8 pages.
Office Action dated Sep. 5, 2022 for Russian Application No. 2019113858, 06 pages.
Office Action dated Sep. 6, 2017 for Korean Application No. 10-2017-7017425, 9 pages.
Office Action dated Sep. 6, 2017 for Korean Application No. 10-2017-7017430, 9 pages.
Office Action dated May 10, 2020 for Brazilian Application No. BR112014004818-5, 6 pages.
Office Action dated Jan. 11, 2019 for European Application No. 12750771.3, 44 pages.
Office Action dated May 11, 2018 for Korean Application No. 10-2017-7008071, 17 pages.
Office Action dated Sep. 11, 2017 for Chinese Application No. 201480024988.3, 10 pages.
Office Action dated May 12, 2017 for Russian Application No. 2016103729, filed Jul. 4, 2014, 15 pages.
Office Action dated Nov. 13, 2017 for Chinese Application No. 2013800472843, 13 pages.
Office Action dated Apr. 14, 2021 for Korean Application No. 10-2020-7036811, 10 pages.
Office Action dated Nov. 14, 2017 for Japanese Application No. 2016-522550, 6 pages.
Office Action dated Aug. 17, 2016 for Korean Application No. 10-2014-7032958, 13 pages.
Office Action dated Jan. 18, 2017 for Chinese Application No. 201480024978.X, 8 pages.
Office Action dated Jul. 18, 2018 for Chinese Application No. 201580022356.8, 15 pages.
Office Action dated Mar. 20, 2019 for Korean Application No. 10-2017-7008071, 2 pages.
Office Action dated Mar. 20, 2019 for Korean Application No. 10-2017-7008071, 3 pages.
Office Action dated May 20, 2022 for Russian Application No. 2021126540, 8 pages.
Office Action dated Sep. 22, 2017 for Russian Application No. 2014120213, 11 pages.
Office Action dated Apr. 24, 2019 for Chinese Application No. 201710413187.1, 16 pages.
Office Action dated Apr. 24, 2019 for Chinese Application No. 201710412726.X, 21 pages.
Office Action dated Jan. 24, 2019 for European Application No. 12750771.3, 40 pages.
Office Action dated Jan. 25, 2019 for European Application No. 12750771.3, 2 pages.
Office Action dated Jan. 25, 2019 for European Application No. 17189951.1, 4 pages.
Office Action dated Dec. 26, 2017 for Chinese Application No. 201480059966.0, 29 pages.
Office Action dated Oct. 26, 2016 for Russian Application No. 2014120213, 7 pages.
Office Action dated Jul. 27, 2018 for Korean Application No. 10-2013-7033866, 22 pages.
Office Action dated Jun. 27, 2017 for Japanese Application No. 2016-527295, 8 pages.
Office Action dated May 27, 2020 for Russian Application No. 2019134684, 8 pages.
Office Action dated Aug. 28, 2019 for Indian Application No. 201647014549, 6 pages.
Office Action dated Jul. 28, 2017 for Korean Application No. 10-2016-7010831, 11 pages.
Office Action dated Aug. 3, 2018 for Chinese Application No. 201580034981.4, 17 pages.
Office Action dated Dec. 30, 2016 for Chinese Application No. 201480024988.3, 26 pages.
Office Action dated Sep. 30, 2018 for Chinese Application No. 201610371843.1, 8 pages.
Office Action dated Jan. 31, 2017 for Japanese Application No. 2016-522550, 7 pages.
Office Action dated Dec. 4, 2018 for Japanese Application No. 2016-575543, 19 pages.
Office Action dated Jul. 4, 2017 for Japanese Application No. 2016-522550, 7 pages.
Office Action dated May 4, 2018 for Chinese Application No. 201610086101.4, 7 pages.
Office Action dated Dec. 5, 2017 for Japanese Application No. 2016-564977, 6 pages.
Office Action dated May 9, 2017 for Chinese Application No. 201480037049.2, 28 pages.
Office Action mailed for Japanese Application No. 2017-017842, dated Dec. 12, 2017, 6 pages.
Patio Kits Direct, "Insulated Roof Panels," DIY Alumawood Patio Cover Kits, dated Sep. 20, 2018, as available at https://www.patiokitsdirect.com/about-insulation, 2 pages.
Rudolph G., "The Influence of CO2 on the Sensory Characteristics of the Favor-System," 1987, Accessed at http://legacy.library.ucsf.edu/tid/sld5f100, 24 pages.
Search Report dated Apr. 14, 2017 for Japanese Application No. 2016-134648, 31 pages.
Search Report dated Sep. 19, 2013 for Japanese Application No. 2011-532464, 116 pages.
Search Report dated Apr. 24, 2017 for Russian Application No. 2015146843, 3 pages.
Search Report dated Mar. 24, 2015 for Chinese Application No. 201280029767.6 filed Aug. 24, 2012, 6 pages.
Search Report dated Apr. 25, 2018 for Chinese Application No. 201610086101.4, 1 page.
Search Report dated Aug. 25, 2015 for Japanese Application No. 2014-179732, 10 pages.
Search Report dated Oct. 25, 2017 for Japanese Application No. 2016-864977, 19 pages.
Search Report dated Apr. 29, 2019 for Russian Application No. 2018137501, 12 pages.
Second Office Action dated Aug. 20, 2013 for Chinese Application No. 200980152395.4, 16 pages.
Summons to Attend Oral Proceedings pursuant to Rule 115(1) EPC mailed May 24, 2022 for European Application No. 18157257.9, 16 pages.
The opposition to petition not to grant of a patent for the Vietnam Application No. 1-2014-03877, mailed on Apr. 27, 2018, 35 pages.
Translation of Office Action dated Mar. 25, 2019 for Chinese Application No. 201610804046.8, 17 pages.
Vietnam Opposition for Application No. PCT/EP2013/057539, mailed on Jun. 29, 2018, 6 pages.

(56) References Cited

OTHER PUBLICATIONS

Virginia R., "A Summary of Findings and Recommendations for the Flexible Heater," Sep. 19, 1990, 8 pages.
Warrier M., et al., "Effect of the Porous Structure of Graphite on Atomic Hydrogen Diffusion and Inventory," Nucl. Fusion, vol. 47, 2007, pp. 1656-1663.
Written Opinion for Application No. PCT/EP2012/066485, dated Oct. 15, 2013, 6 pages.
Written Opinion for Application No. PCT/EP2015/064595, dated Jan. 5, 2016, 11 pages.
Written Opinion for Application No. PCT/GB2015/051213, dated Jul. 16, 2015, 9 pages.
Written Opinion of the International Preliminary Examining Authority for Application No. PCT/EP2015/064595, dated Jun. 13, 2016, 8 pages.

* cited by examiner

ARTICLE FOR USE WITH APPARATUS FOR HEATING SMOKABLE MATERIAL

PRIORITY CLAIM

The present application is a National Phase entry of PCT Application No. PCT/EP2016/070188, filed on 26 Aug. 2016, which claims priority to U.S. patent application Ser. No. 14/840,854, filed on 31 Aug. 2015, which are hereby fully incorporated herein by reference.

TECHNICAL FIELD

The present disclosure relates to articles for use with apparatus for heating smokable material to volatilize at least one component of the smokable material, and to systems comprising such an article and such apparatus.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect of the present disclosure provides an article for use with apparatus for heating smokable material to volatilize at least one component of the smokable material, the article comprising: a cavity configured to receive smokable material; and a coil of heater or heating material that is heatable by penetration with a varying magnetic field to thereby heat the cavity.

In an exemplary embodiment, the article comprises a closed circuit of heating material that is heatable by penetration with a varying magnetic field, wherein the closed circuit comprises the coil.

In an exemplary embodiment, the coil is located in the cavity.

In an exemplary embodiment, the cavity is elongate, and the coil extends along a longitudinal axis that is substantially aligned with a longitudinal axis of the cavity.

In an exemplary embodiment, the heating material comprises one or more materials selected from the group consisting of: an electrically-conductive material, a magnetic material, and a non-magnetic material.

In respective exemplary embodiments, the heating material comprises a metal or a metal alloy.

In an exemplary embodiment, the heating material comprises one or more materials selected from the group consisting of: aluminum, gold, iron, nickel, cobalt, conductive carbon, graphite, plain-carbon steel, stainless steel, ferritic stainless steel, copper, and bronze.

In an exemplary embodiment, the heating material is susceptible to eddy currents being induced in the heating material when penetrated by a varying magnetic field.

In an exemplary embodiment, a first portion of the coil is more susceptible to eddy currents being induced therein by penetration with a varying magnetic field than a second portion of the coil.

In an exemplary embodiment, the article comprises a container defining the cavity.

In an exemplary embodiment, the container is free of material that is heatable by penetration with a varying magnetic field.

In an exemplary embodiment, at least a portion of the container is transparent or translucent.

In an exemplary embodiment, the container is made of glass or a plastics material.

In an exemplary embodiment, the coil is in a fixed position relative to the cavity.

In an exemplary embodiment, the coil is removable from the article.

In an exemplary embodiment, the article comprises the smokable material in the cavity.

In an exemplary embodiment, the heating material is in contact with the smokable material.

In an exemplary embodiment, the smokable material comprises tobacco and/or one or more humectants.

In an exemplary embodiment, the article comprises a mouthpiece defining a passageway that is in fluid communication with the cavity.

In an exemplary embodiment, the article comprises a passageway for fluidly connecting the cavity with an exterior of the article, and an actuator operable to vary a cross sectional area of the passageway.

In an exemplary embodiment, the cavity is sealed from an exterior of the article.

In an exemplary embodiment, the article comprises an air-permeable membrane for admitting air into the cavity from an exterior of the article.

In an exemplary embodiment, the article comprises a seal between the air-permeable membrane and the exterior of the article, wherein the seal seals the air-permeable membrane from the exterior of the article, and wherein the seal is breakable or removable from the article to place the air-permeable membrane in fluid communication with the exterior of the article during use.

In an exemplary embodiment, the article comprises a vapor permeable membrane for permitting vapor generated in the cavity to pass to an exterior of the article during use.

In an exemplary embodiment, the article comprises a seal between the vapor permeable membrane and the exterior of the article, wherein the seal seals the vapor permeable membrane from the exterior of the article, and wherein the seal is breakable or removable from the article to place the vapor permeable membrane in fluid communication with the exterior of the article during use.

In an exemplary embodiment, the article comprises a mass of thermal insulation around the cavity. The thermal insulation may comprise one or more materials selected from the group consisting of: aerogel, vacuum insulation, wadding, fleece, non-woven material, non-woven fleece, woven material, knitted material, nylon, foam, polystyrene, polyester, polyester filament, polypropylene, a blend of polyester and polypropylene, cellulose acetate, paper or card, and corrugated material such as corrugated paper or card.

In an exemplary embodiment, the article comprises a coating on the coil that is smoother or harder than a surface of the coil.

In an exemplary embodiment, the article comprises a catalytic material on at least a portion of the coil.

In an exemplary embodiment, the article comprises a temperature detector for detecting a temperature of the cartridge. In some embodiments, the article comprises one or more terminals connected to the temperature detector for making connection with a temperature monitor of the apparatus in use.

In an exemplary embodiment, the coil of the article is a first coil, and the article comprises a second coil of heating material that is heatable by penetration with a varying magnetic field to heat the cavity.

A second aspect of the present disclosure provides a system, comprising: an article according to the first aspect of the present disclosure; and apparatus having an interface for cooperating with the article, and a magnetic field generator comprising a coil for generating a varying magnetic field for penetrating the coil of the article when the interface is cooperating with the article; wherein an impedance of the coil of the magnetic field generator is equal, or substantially equal, to an impedance of the coil of the article.

In an exemplary embodiment, the interface comprises a recess for receiving at least a portion of the article.

In an exemplary embodiment, the recess is elongate, and the coil of the magnetic field generator extends along a longitudinal axis that is substantially aligned with a longitudinal axis of the recess.

BRIEF DESCRIPTION OF THE DRAWINGS

Embodiments of the disclosure will now be described, by way of example only, with reference to the accompanying drawings, in which.

DETAILED DESCRIPTION

Figure 1:
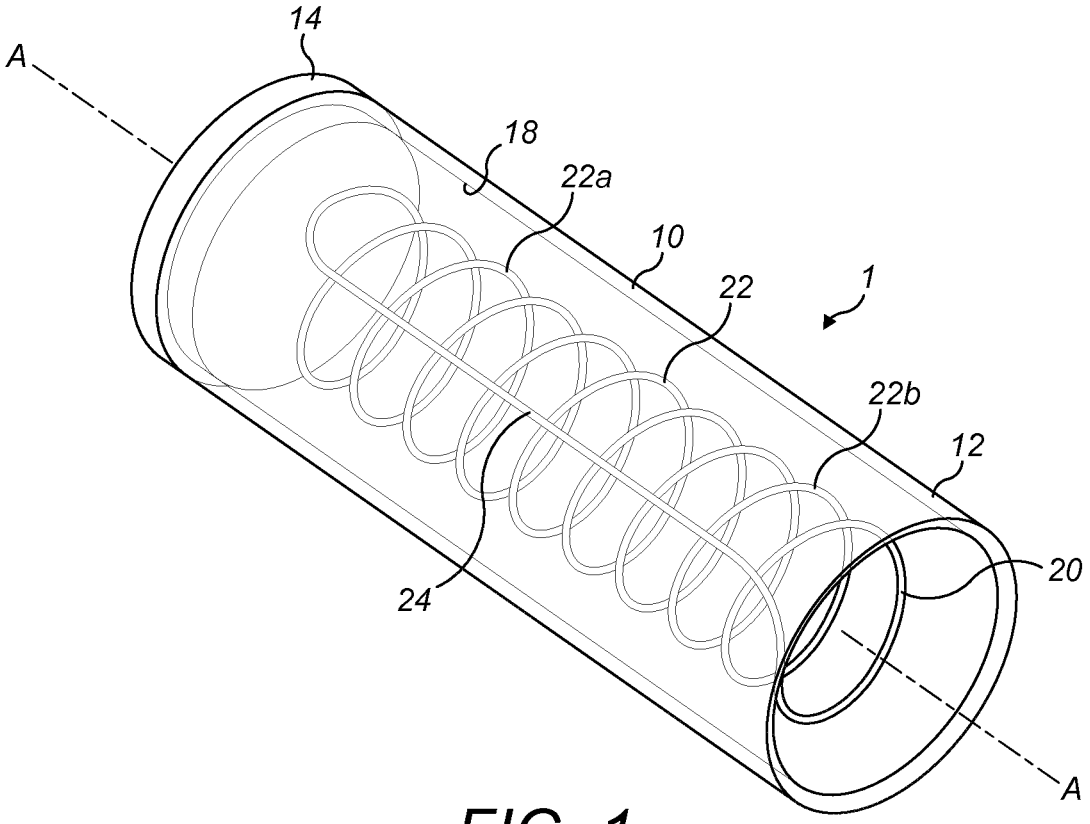
FIG. 1 shows a schematic perspective view of an example of an article for use with apparatus for heating smokable material to volatilize at least one component of the smokable material.

As used herein, the term "smokable material" includes materials that provide volatilized components upon heating, typically in the form of vapor or an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, liquid, gel, gelled sheet, powder, or agglomerates. "Smokable material" also may include other, non-tobacco, products, which, depending on the product, may or may not contain nicotine. "Smokable material" may comprise one or more humectants, such as glycerol or propylene glycol.

As used herein, the terms "heater material" and "heating material" refers to material that is heatable by penetration with a varying magnetic field.

As used herein, the terms "flavor and flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, gel, powder, or the like.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed circuit, magnetic coupling between the susceptor and the electromagnet in use is enhanced, which results in greater or improved Joule heating.

Magnetic hysteresis heating is a process in which an object made of magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, material deposits on the object such as smokable material residue may be less of an issue, design freedom and control over the heating profile may be greater, and cost may be lower.

Referring to FIG. 1 there is shown a schematic perspective view of an example of an article according to an embodiment of the disclosure. The article 1 comprises a container 10 defining a cavity 18 for receiving smokable material 30, and a coil 22 of heating material that is heatable by penetration with a varying magnetic field to heat the cavity 18. That is, the heating material is heatable by penetrating the heating material with a varying magnetic field, and the coil 22 is arranged relative to the cavity 18 so that, when the heating material is penetrated with the varying magnetic field, the heating material heats up and transfers heat energy to the cavity 18 to heat the cavity 18. The article 1 is for use with apparatus for heating smokable material to volatilize at least one component of the smokable material. An example of such apparatus is described below.

In this embodiment, the container 10 comprises a body 12 and an end member 14. In this embodiment, the body 12 is tubular and encircles the cavity 18. In this embodiment, the body 12 is elongate and cylindrical with a substantially circular cross section. However, in other embodiments, the body 12 may have a cross section other than circular and/or not be elongate and/or not be cylindrical. The end member 14 closes a first open end or opening of the tubular body 12. In this embodiment, the end member 14 comprises a plug that is held to the first open end of the tubular body 12, such as by friction or an adhesive. However, in other embodiments the end member 14 may take a different form or be integral with the body 12.

In this embodiment, the article 1 comprises a closed circuit 20 of heating material that is heatable by penetration with a varying magnetic field. Moreover, in this embodiment, the closed circuit 20 comprises the coil 22 and a member 24 of heating material that connects opposite ends of the coil 22 to each other. In other embodiments, the member 24 may be omitted, so that the opposite ends of the coil 22 are connected to each other by only the coil 22 itself. In some embodiments, this can result in magnetic coupling between the coil 22 and the electromagnet in use being enhanced, which results in greater or improved Joule heating.

In this embodiment, the coil 22 is a circular helix. That is, the coil 22 has a substantially constant radius along its length. In other embodiments, the radius of the coil 22 may vary along its length. For example, in some embodiments, the coil 22 may comprise a conic helix or an elliptical helix. In this embodiment, the coil 22 has a substantially constant pitch along its length. That is, a width measured parallel to the longitudinal axis of the coil 22 of a gap between any two adjacent turns of the coil 22 is substantially the same as a width of a gap between any other two adjacent turns of the coil 22. In other embodiments, this may not be true.

In this embodiment, the coil 22 is in a fixed position relative to the cavity 18. In this embodiment, this is effected by the closed circuit 20 being affixed to the end member 14. In some embodiments, the coil 22 may be removable from the article 1, such as for cleaning. Such removability may be provided by way of the coil 22 being detachable from the end member 14, or by way of the combination of the end member 14 and the coil 22 being detachable from the body 12 of the container 10, for example.

In this embodiment, the coil 22 is located in the cavity 18. Therefore, in use, when smokable material 30 is located in the cavity 18, turns of the coil 22 may be surrounded, or substantially surrounded, by the smokable material 30 for effective transfer of heat from the coil 22 to the smokable material 30. That is, the coil 22 may be embedded within the smokable material 30 in use. The coil 22 creates a tortuous flow path through the cavity 18, which may create turbulence in air passing through the cavity 18 so as to help the air to pick up volatilized material created when the smokable material 30 is heated. The coil 22 also has a large surface area per unit longitudinal length, which can result in greater or improved Joule heating of the heating material, and thus greater or improved heating of the smokable material 30. In other embodiments, the coil 22 may be located other than in the cavity 18. For example, the coil 22 may be located within the material of the container 10 itself, in which case the coil 22 would encircle the cavity 18.

In this embodiment, the cavity 18 is elongate, and the coil 22 extends along a longitudinal axis that is substantially aligned with a longitudinal axis A-A of the cavity 18. This can help to provide more uniform heating of the smokable material 30 in use, and can also aid manufacturing of the article 1. In this embodiment, the aligned axes are coincident. In a variation to this embodiment, the aligned axes may be parallel to each other. However, in other embodiments, the axes may be oblique to each other. In some embodiments, the coil 22 may extend to one or both opposite longitudinal ends of the cavity 18. This can help to provide more widespread or yet more uniform heating of the smokable material 30 in use.

The heating material may comprise one or more materials selected from the group consisting of: an electrically-conductive material, a magnetic material, and a non-magnetic material. The heating material may comprise a metal or a metal alloy. The heating material may comprise one or more materials selected from the group consisting of: aluminum, gold, iron, nickel, cobalt, conductive carbon, graphite, plain-carbon steel, stainless steel, ferritic stainless steel, copper, and bronze. Other material(s) may be used in other embodiments. In this embodiment, the heating material of the coil 22 comprises electrically-conductive material. Thus, the heating material is susceptible to eddy currents being induced in the heating material when penetrated by a varying magnetic field. Therefore, the coil 22 is able to act as a susceptor when subjected to the varying magnetic field. It has been found that, when magnetic electrically-conductive material is used as the heating material, magnetic coupling between the coil 22 and coil of the apparatus in use may be enhanced. In addition to potentially enabling magnetic hysteresis heating, this can result in greater or improved Joule heating of the coil 22, and thus greater or improved heating of the smokable material 30.

In some embodiments, the container 10 may be free of material that is heatable by penetration with a varying magnetic field. The container 10 may be made from non-magnetic and non-electrically-conductive material. Such an arrangement can avoid energy of the varying magnetic field being absorbed by the container 10, so that more energy of the varying magnetic field is available to heat the coil 22. In this embodiment, the container 10 is made of glass. In other embodiments, the container 10 may be made of a different material, such as a plastics material. In some embodiments, at least a portion of the container 10 may be transparent or translucent, so as to enable a user to see the contents of the cavity 18. In this embodiment, the body 12 of the container 10 is transparent while the end member 14 is opaque. In other embodiments, the body 12 may be translucent or opaque, for example.

In this embodiment, a first portion 22*a* of the coil 22 is more susceptible to eddy currents being induced therein by penetration with a varying magnetic field than a second portion 22*b* of the coil 22. The first portion 22*a* of the coil 22 may be more susceptible as a result of the first portion 22*a* of the coil 22 being made of a first material, the second portion 22*b* of the coil 22 being made of a different second material, and the first material being of a higher susceptibility to eddy currents being induced therein than the second material. For example, one of the first and second portions 22*a*, 22*b* may be made of iron, and the other of the first and second portions 22*a*, 22*b* may be made of graphite. Alternatively or additionally, the first portion 22*a* of the coil 22 may be more susceptible as a result of the turns of the first portion 22 of the coil 22 having a different thickness and/or material density to the turns of the second portion 22*b* of the coil 22.

The higher susceptibility portion 22*a* may be located closer to an intended mouth end of the article 1, or the lower susceptibility portion 22*b* may be located closer to the intended mouth end of the article 1. In the latter scenario, the lower susceptibility portion 22*b* may heat the smokable material 30 to a lesser degree than the higher susceptibility portion 22*a*, and thus the lesser heated smokable material could act as a filter, to reduce the temperature of created vapor or make the vapor created in the article mild during heating of the smokable material 30.

While in FIG. 1 the first and second portions 22*a*, 22*b* are located adjacent each other in the longitudinal direction of the article 1 or of the coil 22, in other embodiments this need not be the case. For example, in some embodiments the first and second portions 22*a*, 22*b* may be disposed adjacent each other in a direction perpendicular to the longitudinal direction of the article 1 or of the coil 22.

Such varying susceptibility of the coil 22 to eddy currents being induced therein can help achieve progressive heating of the smokable material 30, and thereby progressive generation of vapor. For example, the higher susceptibility portion 22*a* may be able to heat a first region of the smokable material 30 relatively quickly to initialize volatilization of at least one component of the smokable material 30 and formation of a vapor in the first region of the smokable material 30. The lower susceptibility portion 22*b* may be able to heat a second region of the smokable material 30 relatively slowly to initialize volatilization of at least one component of the smokable material 30 and formation of a vapor in the second region of the smokable material 30. Accordingly, a vapor is able to be formed relatively rapidly for inhalation by a user, and vapor can continue to be formed thereafter for subsequent inhalation by the user even after the first region of the smokable material 30 may have ceased generating vapor. The first region of the smokable material 30 may cease generating the vapor when it becomes exhausted of volatilizable components of the smokable material 30.

In other embodiments, all of the coil 22 may be equally, or substantially equally, susceptible to eddy currents being induced therein by penetration with a varying magnetic field. In some embodiments, the coil 22 may not be susceptible to such eddy currents. In such embodiments, the heating material may be a magnetic material that is non-electrically-conductive, and thus may be heatable by the magnetic hysteresis process discussed above.

In some embodiments, the article may comprise a plurality of separate coils 22, wherein each of the coils 22 comprises heating material that is heatable by penetration with a varying magnetic field. At least one of the plurality of coils 22 may be more susceptible to eddy currents being induced therein by penetration with a varying magnetic field than at least one of the other of the plurality of coils 22. This may be effected by the coils 22 being made of different heating materials and/or the turns of the coils 22 having different thicknesses and/or material densities, for example, as discussed above. Again, such varying susceptibility of the coils 22 can help achieve progressive heating of the smokable material 30, and thereby progressive generation of vapor, in a manner corresponding to that described above.

In some embodiments, the article 1 may comprise a catalytic material on at least a portion of the coil 22. The catalytic material may be provided on all of the coil 22, or on only some portion(s) of the coil 22. The catalytic material may take the form of a coating on the coil 22. The provision of such a catalytic material on the coil 22 means that, in use, the article 1 may have a heated, chemically active surface. In use, the catalytic material may act to convert, or increase the rate of conversion of, a potential irritant to something that is less of an irritant. In use, the catalytic material may act to convert, or increase the rate of conversion of, formic acid to methanol, for example. In other embodiments, the catalytic material may act to convert, or increase the rate of conversion of, other chemicals, such as acetylene to ethane by hydrogenation, or ammonia to nitrogen and hydrogen. The catalytic material may additionally or alternatively act to react, or increase the rate of reaction of, carbon monoxide and water vapor to form carbon dioxide and hydrogen (the water-gas shift reaction, or WGSR).

In some embodiments, the article 1 may comprise a coating on the coil 22 that is smoother or harder than a surface of the coil 22 itself. Such a smoother or harder coating may facilitate cleaning of the coil 22 after use of the article 1. The coating could be made of glass or a ceramic material, for example. In other embodiments, the coil 22 may have a rough or non-uniform surface, which can increase the surface area with which the coil 22 contacts the smokable material 30.

In some embodiments, the article 1 may comprise a mass of thermal insulation around the cavity 18. Such a mass may be inside the container 10, outside the container 10, or form the container 10. The thermal insulation may comprise one or more materials selected from the group consisting of: aerogel, vacuum insulation, wadding, fleece, non-woven material, non-woven fleece, woven material, knitted material, nylon, foam, polystyrene, polyester, polyester filament, polypropylene, a blend of polyester and polypropylene, cellulose acetate, paper or card, and corrugated material such as corrugated paper or card. The thermal insulation may additionally or alternatively comprise an air gap. Such thermal insulation can help prevent heat loss to components of the apparatus, and provide more efficient heating of the cavity 18. In some embodiments, the insulation may have a thickness of up to one millimeter, such as up to 0.5 millimeters.

The heating material may have a skin depth, which is an exterior zone within which most of an induced electrical current and/or induced reorientation of magnetic dipoles occurs. By providing that the heating material has a relatively small thickness, a greater proportion of the heating material may be heatable by a given varying magnetic field, as compared to heating material having a depth or thickness that is relatively large as compared to the other dimensions of the heating material. Thus, a more efficient use of material is achieved. In turn, costs are reduced.

Figure 2:
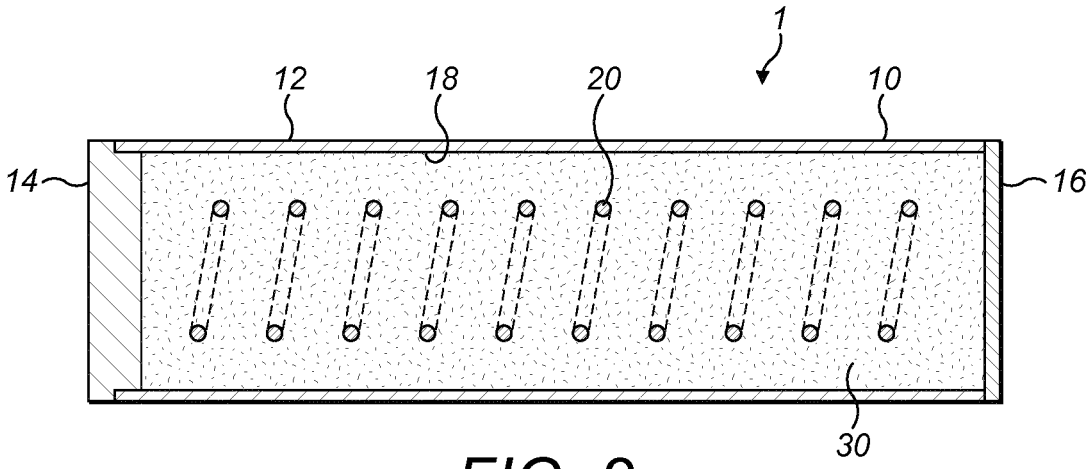
FIG. 2 shows a schematic cross-sectional view of the article of FIG. 1 with smokable material in the cavity and an end closure attached.

Referring to FIG. 2, there is shown a schematic cross-sectional view of the article 1 of FIG. 1 with smokable material 30 in the cavity 18 and an end closure 16 attached to a second open end or opening of the body 10.

In this embodiment, the heating material of the coil 22 is in contact with the smokable material 30. Thus, when the heating material is heated by being penetrated by a varying magnetic field, heat may be transferred directly from the heating material to the smokable material 30. In other embodiments, the heating material may be kept out of contact with the smokable material 30. For example, in some embodiments, the article 1 may comprise a thermally-conductive barrier which spaces the heating material from the smokable material 30. In some embodiments, the thermally-conductive barrier may be a thermally-conductive coating on the coil 22, such as a catalytic coating or a smooth coating as discussed above. The provision of such a thermally-conductive barrier may be advantageous to help to retain heat in the article 1 after heating of the heating material has ceased.

The smokable material 30 could comprise any of the types of smokable materials mentioned herein. The smokable material 30 could be of the form of any of the smokable materials mentioned herein. In some embodiments, the smokable material 30 may comprise a mixture of liquid and powder. The powder could be a suspension in the liquid. The liquid may aid heat retention. The powder may be tobacco powder.

In some embodiments, the end member 14 and the end closure 16 act as respective seals that together seal the cavity 18 from an exterior of the article 1, so as to maintain the freshness of the smokable material 30. In some embodiments, one or both of the end member 14 and the end closure 16 may be openable, puncturable or removable from the article 1 before use, so as to enable air flow through the cavity 18 and thus through the smokable material 30. However, in some embodiments, one or both of the end member 14 and the end closure 16 may comprise an air-permeable membrane or cover for admitting air to pass between the cavity 18 and an exterior of the article 1.

In some embodiments, the article 1 comprises an air-permeable membrane for admitting air into the cavity 18 from an exterior of the article 1, and a seal (such as the end closure 16) between the air-permeable membrane and the exterior of the article 1. The seal seals the air-permeable membrane from the exterior of the article 1 and may be breakable or removable from the article 1 to place the air-permeable membrane, and thus the cavity 18, in fluid communication with the exterior of the article 1. In some embodiments, the article 1 comprises a vapor permeable membrane for permitting vapor generated in the cavity 18 to pass to an exterior of the article 1, and a seal (such as the end member 14) between the vapor permeable membrane and the exterior of the article 1. This seal seals the vapor permeable membrane from the exterior of the article 1 and may be breakable or removable from the article 1 to place the vapor permeable membrane, and thus the cavity 18, in fluid communication with the exterior of the article 1.

In some embodiments, such as some embodiments in which the smokable material comprises a liquid, one or both of the end member 14 and the end closure 16 may comprise a hydrophobic membrane or cover for helping prevent the liquid from escaping from the cavity 18. Indeed, any of the air or vapor permeable membranes discussed herein may comprise a hydrophobic membrane or cover for helping prevent liquid from escaping from the cavity 18.

Figure 3:
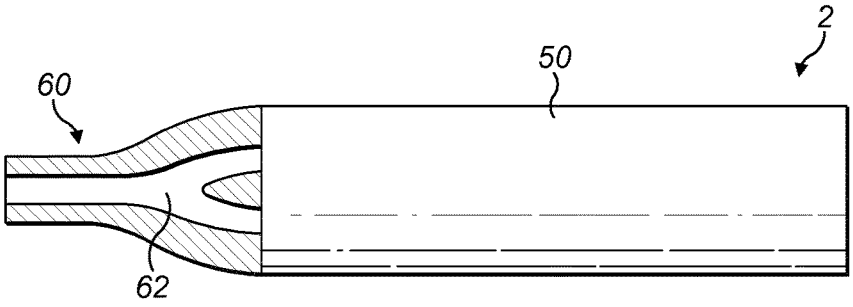
FIG. 3 shows a schematic partial cross-sectional view of an example of another article for use with apparatus for heating smokable material to volatalize at least one component of the smokable material.

In some embodiments, the article may comprise a mouthpiece defining a passageway that is in fluid communication with the cavity 18. Referring to FIG. 3, there is shown a schematic partial cross-sectional view of an example of an article 2 according to an embodiment of the disclosure. The section of the article 2 numbered 50 could comprise either of the constructions shown in FIGS. 1 and 2 or any of the variants thereof discussed above. The mouthpiece 60 and passageway 62 thereof are shown connected to the construction with the passageway 62 aligned so as to be in fluid communication with the cavity 18 of the construction. The mouthpiece 60 may be made of any suitable material, such as a plastics material, cardboard, or rubber.

In use, when the smokable material 30 is heated by the heated heating material, volatilized components of the smokable material 30 can be readily inhaled by a user. In embodiments in which the article is a consumable article, once all or substantially all of the volatilizable component(s) of the smokable material 30 in the article has/have been spent, the user may dispose of the mouthpiece together with the rest of the article. This can be more hygienic than using the same mouthpiece with multiple articles, can help ensure that the mouthpiece is correctly aligned with the smokable material, and presents a user with a clean, fresh mouthpiece each time they wish to use another article.

The mouthpiece 60, when provided, may comprise or be impregnated with a flavorant. The flavorant may be arranged so as to be picked up by heated vapor as the vapor passes through the passageway 62 of the mouthpiece 60 in use.

Figure 4:
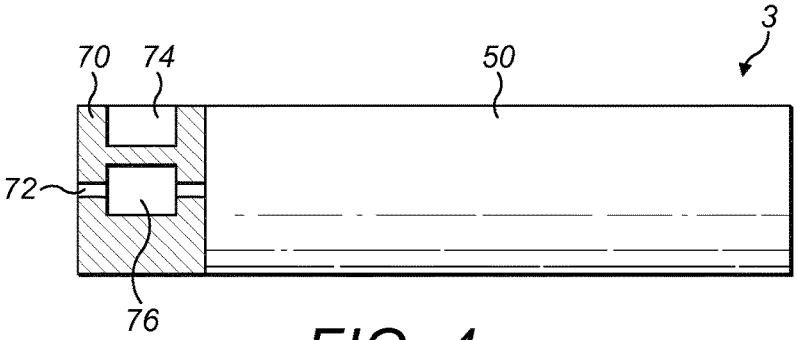
FIG. 4 shows a schematic partial cross-sectional view of an example of another article for use with apparatus for heating smokable material to volatalize at least one component of the smokable material.

In some embodiments, the article may comprise a passageway for fluidly connecting the cavity 18 with an exterior of the article 1, 2, and an actuator operable to vary a cross sectional area of the passageway. Referring to FIG. 4, there is shown a schematic partial cross-sectional view of an example of an article 3 according to an embodiment of the disclosure. The section of the article 3 numbered 50 could comprise any of the constructions shown in FIGS. 1, 2 and 3 or any of the variants thereof discussed above.

In this embodiment, the article 3 comprises an element 70 defining the passageway 72 that fluidly connects the cavity 18 with an exterior of the article 3. The element 70 comprises an actuator 74 that is operable by a user and that is operably connected to a variable constrictor 76. The actuator 74 may comprise, for example, a push-button, a toggle switch, a dial, a touchscreen, or the like. Operation of the actuator 74 by a user causes the variable constrictor 76 to vary a cross sectional area of the passageway 72, so as to change the degree of air flow through the article 3. This can alter the effort required by a user to draw volatilized component(s) of the smokable material 30 from the cavity 18 in use, and can also help a user to retain volatilized component (s) of the smokable material 30 in the cavity 18 between draws.

In some embodiments, the element 70 may be provided at a mouth end, or downstream end, of the cavity 18. In other embodiments, the element 70 may be provided at the end of the cavity 18 opposite to a mouth end of the cavity 18. In some embodiments, the element 70 may be provided at the end of the cavity 18 opposite to an end of the cavity 18 to which a mouthpiece of the article is connected, such as the mouthpiece 60 shown in FIG. 3. In some embodiments, the element 70 may be provided between the cavity 18 and a mouthpiece of the article, such as the mouthpiece 60 shown in FIG. 3. In some embodiments, the element 70 may be combined with a mouthpiece of the article, such as the mouthpiece 60 shown in FIG. 3, so that the passageway of which the cross sectional area is variable is the passageway of the mouthpiece.

Each of the above-described articles 1, 2, 3 and described variants thereof may be used with an apparatus for heating the smokable material 30 to volatilize at least one component of the smokable material 30. The apparatus may be to heat the smokable material 30 to volatilize the at least one component of the smokable material 30 without burning the smokable material 30. Any one of the article(s) 1, 2, 3 and such apparatus may be provided together as a system. The system may take the form of a kit, in which the article 1, 2, 3 is separate from the apparatus. Alternatively, the system may take the form of an assembly, in which the article 1, 2, 3 is combined with the apparatus. An example of such a system will now be described.

Figure 5:
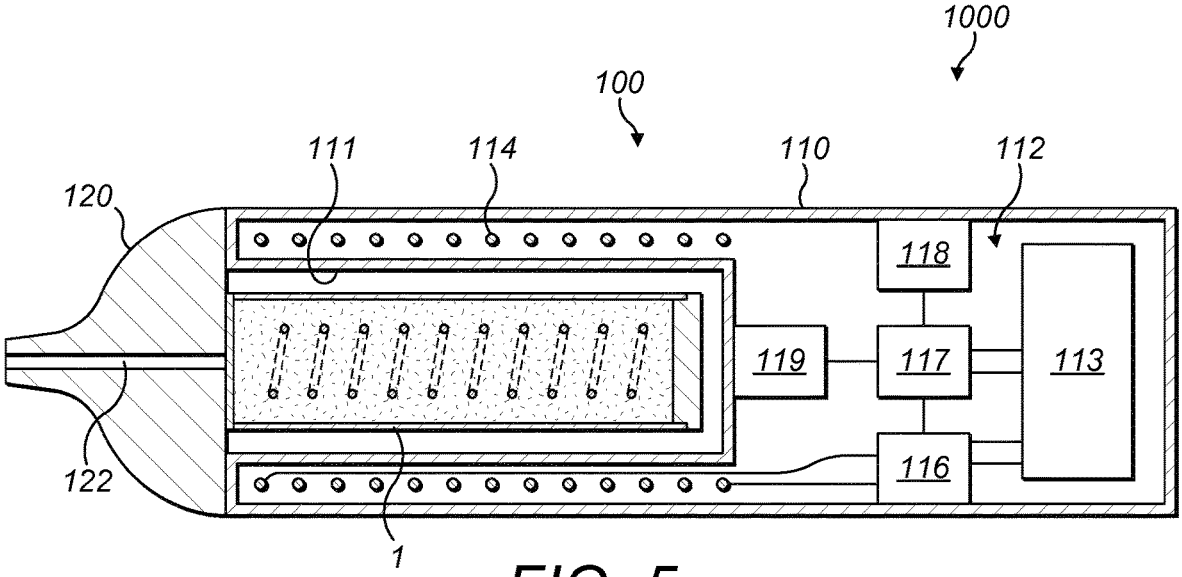
FIG. 5 shows a schematic cross-sectional view of an example of a system comprising the article of FIG. 2 and an apparatus for heating smokable material to volatalize at least one component of the smokable material.

Referring to FIG. 5 there is shown a schematic cross-sectional view of an example of a system according to an embodiment of the disclosure. The system 1000 of this embodiment comprises the article 1 of FIG. 2 and apparatus 100 for heating the smokable material 30 in the article 2 to volatilize at least one component of the smokable material 30. Broadly speaking, the apparatus 100 comprises an interface 111 for cooperating with the article 2, and a magnetic field generator 112 comprising a coil 114 for generating a varying magnetic field for penetrating the coil 22 of the article 2 when the interface 111 is cooperating with the article 2.

The apparatus 100 of this embodiment comprises a body 110 and a mouthpiece 120. The mouthpiece 120 defines a channel 122 therethrough. The mouthpiece 120 is locatable relative to the body 110 so as to cover an opening into the recess 111. When the mouthpiece 120 is so located relative to the body 110, the channel 122 of the mouthpiece 120 is in fluid communication with the recess 111. In use, the channel 122 acts as a passageway for permitting volatilized material to pass from the cavity 18 of the article 2 inserted in the recess 111 to an exterior of the apparatus 100. In this embodiment, the mouthpiece 120 of the apparatus 100 is releasably engageable with the body 110 so as to connect the mouthpiece 120 to the body 110.

In other embodiments, the mouthpiece 120 and the body 110 may be permanently connected, such as through a hinge or flexible member. The mouthpiece 120 of the apparatus 100 may comprise or be impregnated with a flavorant. The flavorant may be arranged so as to be picked up by heated vapor as the vapor passes through the channel 122 of the mouthpiece 120 in use. In some embodiments, such as some embodiments in which the article 2 itself comprises a mouthpiece, the mouthpiece 120 of the apparatus 100 may be omitted.

In this embodiment, the body 110 comprises the interface 111. In this embodiment, the interface 111 comprises a recess 111 for receiving at least a portion of the article 2. In other embodiments, the interface 111 may be other than a recess, such as a shelf, a surface, or a projection, and may require mechanical mating with the article 1, 2, 3 in order to co-operate with the article 1, 2, 3. In this embodiment, the recess 111 is elongate, and is sized and shaped to receive the article 2. In this embodiment, the recess 111 accommodates the whole article 2. In other embodiments, the recess 111 may receive only a portion of the article 2.

In this embodiment, the magnetic field generator 112 comprises an electrical power source 113, the coil 114, a device 116 for passing a varying electrical current, such as an alternating current, through the coil 114, a controller 117, and a user interface 118 for user-operation of the controller 117.

In this embodiment, the electrical power source 113 is a rechargeable battery. In other embodiments, the electrical power source 113 may be other than a rechargeable battery, such as a non-rechargeable battery, a capacitor or a connection to a mains electricity supply.

The coil 114 may take any suitable form. In this embodiment, the coil 114 is a helical coil of electrically-conductive material, such as copper. In some embodiments, the magnetic field generator 112 may comprise a magnetically permeable core around which the coil 114 is wound. Such a magnetically permeable core concentrates the magnetic flux produced by the coil 114 in use and makes a more powerful magnetic field. The magnetically permeable core may be made of iron, for example. In some embodiments, the magnetically permeable core may extend only partially along the length of the coil 114, so as to concentrate the magnetic flux only in certain regions.

In this embodiment, the coil 114 of the magnetic field generator 112 extends along a longitudinal axis that is substantially coincident with a longitudinal axis of the recess 111. In other embodiments, these axes may be aligned with each other by being parallel to each other, or may be oblique to each other. In this embodiment, when the article 2 is received in the recess 111, as shown in FIG. 5, the longitudinal axis of the recess 111 is substantially coincident with the longitudinal axis of the cavity 18 of the article 2.

In this embodiment, an impedance of the coil 114 of the magnetic field generator 112 is equal, or substantially equal, to an impedance of the coil 22 of the article 2. If the impedance of the coil 22 of the article 2 were instead lower than the impedance of the coil 114 of the magnetic field generator 112, then the voltage generated across the coil 22 of the article 2 in use may be lower than the voltage that may be generated across the coil 22 of the article 2 when the impedances are matched. Alternatively, if the impedance of the coil 22 of the article 2 were instead higher than the impedance of the coil 114 of the magnetic field generator 112, then the electrical current generated in the coil 22 of the article 2 in use may be lower than the current that may be generated in the coil 22 of the article 2 when the impedances are matched. Matching the impedances may help to balance the voltage and current to maximize the heating power generated at the coil 22 of the article 2 when heated in use.

While the system 1000 of this embodiment comprises the article 2 of FIG. 2, in other embodiments the system may comprise any other one of the articles discussed above. In such other embodiments, the impedance of the coil 114 of the magnetic field generator 112 may be equal, or substantially equal, to an impedance of the coil of the article.

In this embodiment, the device 116 for passing a varying current through the coil 114 is electrically connected between the electrical power source 113 and the coil 114. In this embodiment, the controller 117 also is electrically connected to the electrical power source 113, and is communicatively connected to the device 116 to control the device 116. More specifically, in this embodiment, the controller 117 is for controlling the device 116, so as to control the supply of electrical power from the electrical power source 113 to the coil 114. In this embodiment, the controller 117 comprises an integrated circuit (IC), such as an IC on a printed circuit board (PCB). In other embodiments, the controller 117 may take a different form. In some embodiments, the apparatus may have a single electrical or electronic component comprising the device 116 and the controller 117. The controller 117 is operated in this embodiment by user-operation of the user interface 118. The user interface 118 is located at the exterior of the body 110. The user interface 118 may comprise a push-button, a toggle switch, a dial, a touchscreen, or the like.

In this embodiment, operation of the user interface 118 by a user causes the controller 117 to cause the device 116 to cause an alternating electrical current to pass through the coil 114, so as to cause the coil 114 to generate an alternating magnetic field. When the article 2 is located in the recess 111, the coil 114 of the apparatus 100 and the coil 22 of the article 2 are suitably relatively positioned so that the alternating magnetic field produced by the coil 114 penetrates the heating material of the coil 22 of the article 2. When the heating material of the coil 22 is an electrically-conductive material, this may cause the generation of one or more eddy currents in the heating material. The flow of eddy currents in the heating material against the electrical resistance of the heating material causes the heating material to be heated by Joule heating. As mentioned above, when the heating material is made of a magnetic material, the orientation of magnetic dipoles in the heating material changes with the changing applied magnetic field, which causes heat to be generated in the heating material.

The apparatus 100 of this embodiment comprises a temperature sensor 119 for sensing a temperature of the recess 111. The temperature sensor 119 is communicatively connected to the controller 117, so that the controller 117 is able to monitor the temperature of the recess 111. In some embodiments, the temperature sensor 119 may be arranged to take an optical temperature measurement of the recess, interface or article 1, 2, 3. In some embodiments, the article 1, 2, 3 may comprise a temperature detector, such as a resistance temperature detector (RTD), for detecting a temperature of the article 1, 2, 3. For example, the temperature detector may be located in or on the container 10 of the article 1, 2, 3. The article 1, 2, 3 may further comprise one or more terminals connected, such as electrically-connected, to the temperature detector. The terminal(s) may be for making connection, such as electrical connection, with a temperature monitor of the apparatus 100 when the article 1, 2, 3 is in the recess 111 or cooperating with the interface. The controller 117 may comprise the temperature monitor. The temperature monitor of the apparatus 100 may thus be able to determine a temperature of the article 1, 2, 3 during use of the article 1, 2, 3 with the apparatus 100.

In some embodiments, by providing that the heating material of the coil 22 of the article 2 has a suitable resistance, the response of the heating material to a change in temperature could be sufficient to give information regarding temperature inside the article 2. The temperature sensor 119 of the apparatus 100 may then comprise a probe for analyzing the heating material.

On the basis of one or more signals received from the temperature sensor 119 or temperature detector, the controller 117 may cause the device 116 to adjust a characteristic of the varying or alternating electrical current passed through the coil 114 as necessary, in order to ensure that the temperature of the recess 111 remains within a predetermined temperature range. The characteristic may be, for example, amplitude or frequency. Within the predetermined temperature range, in use the smokable material 30 within an article 1, 2, 3 located in the recess 111 is heated sufficiently to volatalize at least one component of the smokable material 30 without combusting the smokable material 30. Accordingly, the controller 117, and the apparatus 100 as a whole, is arranged to heat the smokable material 30 to volatalize the at least one component of the smokable material 30 without combusting the smokable material 30. In some embodiments, the temperature range is about 50° C. to about 250° C., such as between about 50° C. and about 150° C., between about 50° C. and about 120° C., between about 50° C. and about 100° C., between about 50° C. and about 80° C., or between about 60° C. and about 70° C. In some embodiments, the temperature range is between about 170° C. and about 220° C. In other embodiments, the temperature range may be other than this range.

The apparatus 100 may define an air inlet that fluidly connects the recess 111 with the exterior of the apparatus 100. Such an air inlet may be defined by the body 110 of the apparatus 100 and/or by the mouthpiece 120 of the apparatus 100. A user may be able to inhale the volatalized component(s) of the smokable material 30 by drawing the volatalized component(s) through the channel 122 of the mouthpiece 120. As the volatalized component(s) are removed from the cavity 18 of the container 10 of the article 2, air may be drawn into the recess 111 via the air inlet of the apparatus 100. Furthermore, in embodiments in which the end member 14 and/or end closure 16 of the container 10 of the article 2 is/are puncturable, the air may be drawn into the cavity 18 of the container 10 via one or both of the punctured end member 14 and end closure 16. Alternatively, in embodiments in which the article 2 comprises an air-permeable membrane for admitting air into the cavity 18 from the exterior of the article 2, a vapor permeable membrane for permitting vapor generated in the cavity 18 to pass to the exterior of the article 2, and first and second seals between the exterior of the article 2 and the air-permeable membrane and the vapor permeable membrane, respectively, a user may break or remove the first and second seals prior to use of the apparatus 100 and article 2 to enable air to be drawn into the cavity 18 via the air-permeable membrane, and vapor generated in the cavity 18 to pass to the channel 122 of the mouthpiece 120 via the vapor permeable membrane.

The apparatus may provide haptic feedback to a user. The feedback could indicate that heating is taking place, or be triggered by a timer to indicate that greater than a predetermined proportion of the original quantity of volatilizable component(s) of the smokable material 30 in the article 1, 2, 3 has/have been spent, or the like. The haptic feedback could be created by interaction of the coils (i.e. magnetic response), by interaction of an electrically-conductive element with the coil 114 of the apparatus 100, by rotating an unbalanced motor, by repeatedly applying and removing a current across a piezoelectric element, or the like.

The apparatus 100 may comprise more than one coil. The plurality of coils of the apparatus 100 could be operable to provide progressive heating of the smokable material 30 in an article 1, 2, 3, and thereby progressive generation of vapor. For example, one coil may be able to heat a first region of the heating material relatively quickly to initialize volatilization of at least one component of the smokable material 30 and formation of a vapor in a first region of the smokable material 30. Another coil may be able to heat a second region of the heating material relatively slowly to initialize volatilization of at least one component of the smokable material 30 and formation of a vapor in a second region of the smokable material 30. Accordingly, a vapor is able to be formed relatively rapidly for inhalation by a user, and vapor can continue to be formed thereafter for subsequent inhalation by the user even after the first region of the smokable material 30 may have ceased generating vapor. The initially-unheated second region of smokable material 30 could act as a filter, to reduce the temperature of created vapor or make the created vapor mild, during heating of the first region of smokable material 30.

In some embodiments, the coil of the article is a first coil, and the article may comprise a second coil of heating material that is heatable by penetration with a varying magnetic field to heat the cavity 18 of the article. The first and second coils of the article may be substantially separately heatable by varying magnetic fields produced by a respective plurality of coils of the apparatus 100. One of the first and second coils may be more susceptible to eddy currents being induced therein by penetration with a varying magnetic field than the other of the first and second coils. Such a structure could be operable to provide progressive heating of the smokable material 30 in the article, and thereby progressive generation of vapor, in a similar way to that described above.

In some embodiments, the heating material of the coil 22 may comprise discontinuities or holes therein. Such discontinuities or holes may act as thermal breaks to control the degree to which different regions of the smokable material are heated in use. Areas of the heating material with discontinuities or holes therein may be heated to a lesser extent that areas without discontinuities or holes. This may help progressive heating of the smokable material, and thus progressive generation of vapor, to be achieved.

In each of the above described embodiments, the smokable material 30 comprises tobacco. However, in respective variations to each of these embodiments, the smokable material 30 may consist of tobacco, may consist substantially entirely of tobacco, may comprise tobacco and smokable material other than tobacco, may comprise smokable material other than tobacco, or may be free of tobacco. In some embodiments, the smokable material 30 may comprise a vapor or aerosol forming agent or a humectant, such as glycerol, propylene glycol, triactein, or diethylene glycol.

An article embodying the present disclosure may be a cartridge or a capsule, for example.

Each of the above described articles 1, 2, 3 may be used as a consumable article. Once all, or substantially all, of the volatilizable component(s) of the smokable material 30 in the article 1, 2, 3 has/have been spent, the user may remove the article 1, 2, 3 from the apparatus 100 and dispose of the article 1, 2, 3. The user may subsequently re-use the apparatus 100 with another of the articles 1, 2, 3. However, in other embodiments, the articles 1, 2, 3 may be refillable with smokable material 30 and re-usable with the apparatus 100. Such re-filling may be effected by detaching the end closure 16 from the body 12 of the container 10 to access the cavity 18, removing the remains of smokable material used in a previous session, placing a new charge of smokable material in the cavity 18, and then placing an end closure 16 (either the original end closure 16 or a new end closure 16) over the second open end of the body 12 of the container 10. During such re-filling, the coil 22 may be removable, for example for cleaning or for replacement with a fresh coil 22.

Each of the above described articles 1, 2, 3 may be supplied with or without the smokable material 30 in the cavity 18.

In some embodiments, the articles 1, 2, 3 discussed above are sold, supplied or otherwise provided separately from the apparatus 100 with which they are usable. However, in some embodiments, the apparatus and one or more of the articles 1, 2, 3 may be provided together as a system, such as a kit or an assembly, possibly with additional components, such as cleaning utensils.

Embodiments of the disclosure could be implemented in a system comprising any one of the articles discussed herein, and any one of the apparatuses discussed herein, wherein the apparatus itself further has heating material, such as in a susceptor, for heating by penetration with the varying magnetic field generated by the magnetic field generator. Heat generated in the heating material of the apparatus itself could be transferred to the article to further heat the smokable material therein.

In order to address various issues and advance the art, the entirety of this disclosure shows by way of illustration and example various embodiments in which the claimed invention may be practiced and which provide for superior articles for use with apparatus for heating smokable material to volatalize at least one component of the smokable material, and superior systems comprising the same. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An article for use with an apparatus configured to heat smokable material to volatilize at least one component of the smokable material, the article comprising:

a container defining a cavity configured to receive a smokable material;

the smokable material received in the cavity; and a closed circuit of heater material that is heatable via penetration with a varying magnetic field and to thereby heat the smokable material to volatilize at least one component of the smokable material, the closed circuit including a helical coil of heater material and a member of heater material connecting opposite ends of the helical coil to each other; and wherein the smokable material is at least one of ground tobacco, cut rag tobacco, extruded tobacco, gel, gelled sheet, powder, or agglomerates.

2. The article of claim 1, wherein the cavity is elongate, and wherein the heater material extends along a longitudinal axis that is substantially aligned with a longitudinal axis of the cavity.

3. The article of claim 1, wherein the heater material comprises one or more materials selected from the group consisting of: an electronically-conductive material, a magnetic material, and a non-magnetic material.

4. The article of claim 1, wherein the heater material comprises one or more material selected from the group consisting of: aluminum, gold, iron, nickel, cobalt, conductive carbon, graphite, plain-carbon steel, stainless steel, ferritic stainless steel, copper, and bronze.

5. The article of claim 1, wherein a first portion of the heater material is more susceptible to eddy currents induced therein by penetration with a varying magnetic field than a second portion of the heater material.

6. The article of claim 5, wherein the first portion comprises a first material and the second portion comprises a second material which is different to the first material.

7. The article of claim 5, wherein the first portion comprises at least one of a first thickness or a first material density, and the second portion comprises at least one of a second thickness or a second material density which is different to the first thickness or the first material density, respectively.

8. The article of claim 5, wherein the first and second portions are disposed adjacent each other in a direction perpendicular to the longitudinal direction of the article or of the heater material.

9. The article of claim 1, wherein the container is free of material that is heatable by penetration with a varying magnetic field.

10. The article of claim 1, wherein the smokable material includes at least one of tobacco or one or more humectants.

11. The article of claim 1, further comprising a mouthpiece that defines a passageway that is in fluid communication with the cavity.

12. The article of claim 1, wherein the cavity is sealed from an exterior of the article.

13. The article of claim 1, further comprising an air-permeable membrane configured to admit air into the cavity from an exterior of the article during use.

14. The article of claim 13, further comprising a seal disposed between the air-permeable membrane and the exterior of the article, wherein the seal seals the air-permeable membrane from the exterior of the article, and the seal is breakable or removable from the article so as to place the air-permeable membrane in fluid communication with the exterior of the article during use.

15. The article of claim 1, wherein the heater material is disposed in the cavity.

16. The article of claim 1, wherein the heater material is in contact with the smokable material and wherein the heater material is embedded within the smokable material.

17. The article of claim 1, wherein the container comprises:

a body having a first opened end; and an end member closing the first open end of the body;

wherein the end member is removable from the article, and wherein the closed circuit of heater material is affixed to the end member such that the closed circuit of heater material is removable from the article; and wherein the container is free of material that is heatable by penetration with a varying magnetic field so as to avoid energy of the varying magnetic field being absorbed by the container in use.

18. The article of claim 12, wherein, the end member comprises an air-permeable membrane configured to enable airflow through the cavity and thus through the smokable material received in the cavity.

19. The article of claim 17, comprising the smokable material is received in the cavity, wherein the entirety of the closed circuit is embedded within the smokable material.

20. The article of claim 1, wherein the container comprises:

a body having a first opened end; and an end member closing the first open end of the body;

wherein the end member is configured to be openable to enable, in use, airflow through the cavity and thus through the smokable material received in the cavity.

21. An article for use with an apparatus configured to heat smokable material to volatilize at least one component of the smokable material, the article comprising:

a container defining a cavity configured to receive a smokable material;

the smokable material received in the cavity;

a helical coil of heater material that is heatable via penetration with a varying magnetic field; and a closed circuit of heater material that is heatable via penetration with a varying magnetic field and to thereby heat the smokable material to volatilize at least one component of the smokable material, the closed circuit including the helical coil of heater material and a member of heater material connecting opposite ends of the helical coil to each other, wherein the entirety of the closed circuit is disposed in the cavity; and wherein the smokable material is at least one of ground tobacco, cut rag tobacco, extruded tobacco, gel, gelled sheet, powder, or agglomerates.

* * * * *